US008899378B2

(12) United States Patent
Wood et al.

(10) Patent No.: US 8,899,378 B2
(45) Date of Patent: Dec. 2, 2014

(54) COMPRESSOR INTAKE MUFFLER AND FILTER

(71) Applicant: Black & Decker Inc., Newark, DE (US)

(72) Inventors: Mark W. Wood, Cedar Grove, TN (US); Stephen J. Vos, Jackson, TN (US); Scott D. Craig, Jackson, TN (US); Gary D. White, Medina, TN (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 13/987,843

(22) Filed: Sep. 9, 2013

(65) Prior Publication Data

US 2014/0007944 A1 Jan. 9, 2014

Related U.S. Application Data

(63) Continuation-in-part of application No. 13/609,363, filed on Sep. 11, 2012.

(60) Provisional application No. 61/534,046, filed on Sep. 13, 2011, provisional application No. 61/533,993, filed on Sep. 13, 2011, provisional application No. 61/534,001, filed on Sep. 13, 2011, provisional application No. 61/534,009, filed on Sep. 13, 2011, provisional application No. 61/534,015, filed on Sep. 13, 2011.

(51) Int. Cl.
*F02M 35/00* (2006.01)

(52) U.S. Cl.
USPC ..... 181/229

(58) Field of Classification Search
CPC ..... F02M 35/12
USPC ..... 181/229
See application file for complete search history.

(56) References Cited

U.S. PATENT DOCUMENTS

| | | | |
|---|---|---|---|
| 1,381,056 | A | 6/1921 | Blakely |
| 1,694,218 | A | 6/1924 | Hazard |
| 1,924,654 | A | 3/1930 | Petersen |
| 2,059,894 | A | 6/1933 | Newman |
| 2,136,098 | A | 7/1937 | Browne |

(Continued)

FOREIGN PATENT DOCUMENTS

| | | | |
|---|---|---|---|
| DE | 10117791 | A1 | 10/2002 |
| EP | 2320085 | A2 | 5/2011 |

(Continued)

OTHER PUBLICATIONS

European Search Report for EP 13 18 4002, EPO (Nov. 29, 2013).

(Continued)

*Primary Examiner* — Forrest M Phillips
(74) *Attorney, Agent, or Firm* — Wright IP & International Law

(57) ABSTRACT

A compressor assembly having a high velocity muffler system which produces a particle-free compressor pump feed while reducing noise output from the compressor assembly during compressing operations. The high velocity muffler system is maintenance-free and comprises an inertia filter. The compressor assembly uses a method for producing a compressor pump feed and reducing noise during compressing operations by processing a gas through the high velocity muffler system which has an inertia filter and a muffler chamber to produce a compressor pump feed which can be compressed by a pump assembly.

20 Claims, 35 Drawing Sheets

(56) References Cited

U.S. PATENT DOCUMENTS

| | | | | |
|---|---|---|---|---|
| 2,312,596 | A | 2/1940 | Smith | |
| 2,343,952 | A | 2/1943 | Branstrom | |
| 2,375,442 | A | 5/1945 | Sandberg | |
| D181,459 | S | 11/1957 | Bullock | |
| 3,525,606 | A | 8/1970 | Bodine | |
| 3,537,544 | A | 11/1970 | King et al. | |
| 3,710,094 | A | 1/1973 | Monte et al. | |
| 3,736,074 | A * | 5/1973 | Kilbane et al. | 417/279 |
| 3,930,558 | A | 1/1976 | Schnell et al. | |
| 3,955,900 | A | 5/1976 | Vinci | |
| 3,978,919 | A | 9/1976 | Fachbach et al. | |
| 3,980,912 | A | 9/1976 | Panza | |
| 4,190,402 | A | 2/1980 | Meece et al. | |
| 4,264,282 | A | 4/1981 | Crago | |
| 4,289,630 | A | 9/1981 | Schmidt, Jr. et al. | |
| 4,302,224 | A | 11/1981 | McCombs et al. | |
| D263,216 | S | 3/1982 | Maher | |
| 4,342,573 | A | 8/1982 | McCombs et al. | |
| 4,401,418 | A | 8/1983 | Fritchman | |
| 4,460,319 | A | 7/1984 | Ashikian | |
| 4,553,903 | A | 11/1985 | Ashikian | |
| 4,566,800 | A | 1/1986 | Bodine | |
| 4,722,673 | A | 2/1988 | Grime et al. | |
| 4,907,546 | A | 3/1990 | Ishii et al. | |
| 4,928,480 | A | 5/1990 | Oliver et al. | |
| 4,950,133 | A | 8/1990 | Sargent | |
| 4,988,268 | A | 1/1991 | Kurihara | |
| 5,020,973 | A | 6/1991 | Lammers | |
| 5,133,475 | A | 7/1992 | Sharp | |
| 5,137,434 | A | 8/1992 | Wheeler et al. | |
| D335,407 | S | 5/1993 | Ngian et al. | |
| 5,213,484 | A | 5/1993 | Hashimoto et al. | |
| 5,252,035 | A | 10/1993 | Lee | |
| 5,311,625 | A | 5/1994 | Barker et al. | |
| 5,336,046 | A | 8/1994 | Hashimoto et al. | |
| 5,407,330 | A | 4/1995 | Rimington et al. | |
| 5,417,258 | A | 5/1995 | Privas | |
| 5,526,228 | A | 6/1996 | Dickson et al. | |
| 5,620,370 | A | 4/1997 | Umai et al. | |
| 5,678,543 | A | 10/1997 | Bower | |
| 5,725,361 | A | 3/1998 | Dantlgraber | |
| 6,023,938 | A | 2/2000 | Taras et al. | |
| 6,091,160 | A | 7/2000 | Kouchi et al. | |
| 6,099,268 | A | 8/2000 | Pressel | |
| 6,100,599 | A | 8/2000 | Kouchi et al. | |
| 6,145,974 | A | 11/2000 | Shinada et al. | |
| D437,581 | S | 2/2001 | Aruga et al. | |
| D437,825 | S | 2/2001 | Imai | |
| 6,206,654 | B1 | 3/2001 | Cassidy | |
| D444,796 | S | 7/2001 | Morgan | |
| D444,797 | S | 7/2001 | Davis et al. | |
| 6,257,842 | B1 | 7/2001 | Kawasaki et al. | |
| 6,331,740 | B1 | 12/2001 | Morohoshi et al. | |
| D454,357 | S | 3/2002 | Diels | |
| 6,357,338 | B2 | 3/2002 | Montgomery | |
| 6,362,533 | B1 | 3/2002 | Morohoshi et al. | |
| 6,378,468 | B1 | 4/2002 | Kouchi et al. | |
| 6,378,469 | B1 | 4/2002 | Hiranuma et al. | |
| 6,386,833 | B1 | 5/2002 | Montgomery | |
| D461,196 | S | 8/2002 | Buck | |
| 6,428,283 | B1 | 8/2002 | Bonior | |
| 6,428,288 | B1 | 8/2002 | King | |
| 6,431,839 | B2 | 8/2002 | Gruber et al. | |
| 6,435,076 | B2 | 8/2002 | Montgomery | |
| 6,447,257 | B2 | 9/2002 | Orschell | |
| 6,454,527 | B2 | 9/2002 | Nishiyama et al. | |
| 6,474,954 | B1 | 11/2002 | Bell et al. | |
| 6,554,583 | B1 | 4/2003 | Pressel | |
| 6,682,317 | B2 | 1/2004 | Chen | |
| 6,751,941 | B2 | 6/2004 | Edelman et al. | |
| 6,784,560 | B2 | 8/2004 | Sugimoto et al. | |
| 6,790,012 | B2 | 9/2004 | Sharp et al. | |
| 6,814,659 | B2 | 11/2004 | Cigelske, Jr. | |
| D499,431 | S | 12/2004 | Chen | |
| 6,952,056 | B2 | 10/2005 | Brandenburg et al. | |
| 6,962,057 | B2 | 11/2005 | Kurokawa et al. | |
| 6,991,436 | B2 | 1/2006 | Beckman et al. | |
| 6,998,725 | B2 | 2/2006 | Brandenburg et al. | |
| D517,009 | S | 3/2006 | Xiao | |
| D521,929 | S | 5/2006 | Xiao | |
| D531,193 | S | 10/2006 | Caito | |
| 7,147,444 | B2 | 12/2006 | Cheon | |
| D536,348 | S | 2/2007 | Bass | |
| D536,708 | S | 2/2007 | Bass | |
| 7,189,068 | B2 | 3/2007 | Thomas, Jr. et al. | |
| D551,141 | S | 9/2007 | Canitano | |
| 7,283,359 | B2 | 10/2007 | Bartell et al. | |
| 7,306,438 | B2 * | 12/2007 | Kang et al. | 417/417 |
| 7,316,291 | B2 * | 1/2008 | Thomsen et al. | 181/262 |
| D566,042 | S | 4/2008 | Yamasaki et al. | |
| D568,797 | S | 5/2008 | Elwell | |
| D572,658 | S | 7/2008 | Yamamoto et al. | |
| 7,392,770 | B2 | 7/2008 | Xiao | |
| 7,398,747 | B2 | 7/2008 | Onodera et al. | |
| 7,398,855 | B2 | 7/2008 | Seel | |
| 7,400,501 | B2 | 7/2008 | Bartell et al. | |
| D576,723 | S | 9/2008 | Achen | |
| 7,430,992 | B2 | 10/2008 | Murakami et al. | |
| 7,452,256 | B2 | 11/2008 | Kasai et al. | |
| 7,491,264 | B2 | 2/2009 | Tao et al. | |
| D588,987 | S | 3/2009 | Kato | |
| D589,985 | S | 4/2009 | Steinfels | |
| D593,032 | S | 5/2009 | Wang et al. | |
| 7,563,077 | B2 | 7/2009 | Santa Ana | |
| D600,205 | S | 9/2009 | Imai | |
| 7,597,340 | B2 | 10/2009 | Hirose et al. | |
| 7,614,473 | B2 | 11/2009 | Ono et al. | |
| 7,643,284 | B2 | 1/2010 | Nakamura | |
| 7,678,165 | B2 | 3/2010 | Tingle et al. | |
| 7,707,711 | B2 | 5/2010 | Bartell et al. | |
| 7,743,739 | B2 | 6/2010 | Kochi et al. | |
| 7,779,792 | B2 | 8/2010 | Kubo et al. | |
| 7,779,793 | B2 | 8/2010 | Ito et al. | |
| 7,854,517 | B2 | 12/2010 | Tsubura | |
| 8,215,448 | B2 * | 7/2012 | Harting et al. | 181/229 |
| 8,230,968 | B2 * | 7/2012 | Jung et al. | 181/229 |
| 8,246,320 | B2 * | 8/2012 | Park et al. | 417/312 |
| 8,327,975 | B2 * | 12/2012 | Ortman et al. | 181/264 |
| 8,584,795 | B1 * | 11/2013 | Buckner | 181/224 |
| 2002/0134617 | A1 * | 9/2002 | Nissen et al. | 181/403 |
| 2002/0185333 | A1 * | 12/2002 | Svendsen | 181/229 |
| 2004/0103683 | A1 * | 6/2004 | Yoon | 62/296 |
| 2005/0092544 | A1 | 5/2005 | Lee | |
| 2005/0220640 | A1 | 10/2005 | Finkenbinder et al. | |
| 2006/0104830 | A1 | 5/2006 | Fields | |
| 2006/0104833 | A1 | 5/2006 | Hueppchen | |
| 2006/0104834 | A1 | 5/2006 | Stilwell | |
| 2006/0104837 | A1 | 5/2006 | Lee et al. | |
| 2008/0045368 | A1 | 2/2008 | Nishihara | |
| 2008/0053746 | A1 | 3/2008 | Albert et al. | |
| 2008/0152518 | A1 | 6/2008 | Stilwell | |
| 2009/0016902 | A1 | 1/2009 | Lee et al. | |
| 2010/0112929 | A1 | 5/2010 | Iantorno | |
| 2010/0225012 | A1 | 9/2010 | Fitton et al. | |
| 2010/0226750 | A1 | 9/2010 | Gammack | |
| 2010/0226771 | A1 | 9/2010 | Crawford et al. | |
| 2010/0226787 | A1 | 9/2010 | Gammack et al. | |
| 2010/0317281 | A1 | 12/2010 | Sperandio et al. | |
| 2011/0094052 | A1 | 4/2011 | Witter | |
| 2011/0095540 | A1 | 4/2011 | Jackson et al. | |
| 2011/0182754 | A1 | 7/2011 | Gathers et al. | |

FOREIGN PATENT DOCUMENTS

| | | | |
|---|---|---|---|
| JP | 54041562 | A | 4/1979 |
| JP | 1080793 | A | 3/1989 |
| JP | 4232390 | A | 8/1992 |
| JP | 5133330 | A | 5/1993 |
| JP | 7109977 | A | 4/1995 |
| JP | 9250456 | A | 9/1997 |
| JP | 9250457 | A | 9/1997 |

(56) References Cited

FOREIGN PATENT DOCUMENTS

| | | | |
|---|---|---|---|
| JP | 10148135 | A | 6/1998 |
| JP | 10339268 | A | 12/1998 |
| JP | 2003065241 | A | 3/2003 |
| JP | 2006292243 | A | 10/2006 |
| WO | 2008021251 | A2 | 2/2008 |
| WO | 2009152594 | A1 | 12/2009 |

OTHER PUBLICATIONS

European Search Report for EP 13 18 3932, EPO (Nov. 29, 2013).

* cited by examiner

| Sound Level | Pump Air Delivery | Maximum Pressure | Heat Transfer Rate | Cooling Fan Flowrate | Pump Speed | Cylinder Bore | Stroke | Swept Volume | Volumetric Efficiency | Input Power | Motor Efficiency |
|---|---|---|---|---|---|---|---|---|---|---|---|
| (dBA) | (SCFM@90 psig) | (psig) | BTU/min | (CFM) | (rpm) | (inches) | (inches) | inches^3 | (% at 150 psig) | (Watts) | (%) |
| 65 – 75 | 2.4 - 3.5 | | | | | | | | | | |
| 65 – 75 | | 150 - 250 | | | | | | | | | |
| 65 – 75 | | | 60 - 200 | | | | | | | | |
| 65 – 75 | | | | 50 - 100 | | | | | | | |
| 65 – 75 | 2.4 - 3.5 | 150 - 250 | 60 - 200 | | | | | | | | |
| 65 – 75 | 2.4 - 3.5 | 150 - 250 | | 50 - 100 | | | | | | | |
| 65 – 75 | 2.4 - 3.5 | 150 - 250 | | | 1500 - 3000 | 1.5 - 2.25 | 1.3 - 2 | | | | |
| 65 – 75 | 2.4 - 3.5 | 150 - 250 | | | | | | 2.3 - 8 | 33 - 50 | | |
| 65 – 75 | 2.4 - 3.5 | 150 - 250 | | | | | | | | 1000-1800 | 45 - 65 |

FIG. 17

| Sound Level | Pump Air Delivery | Maximum Pressure | Heat Transfer Rate | Cooling Fan Flowrate | Pump Speed | Cylinder Bore | Stroke | Swept Volume | Volumetric Efficiency | Input Power | Motor Efficiency |
|---|---|---|---|---|---|---|---|---|---|---|---|
| (dBA) | (SCFM@90 psig) | (psig) | BTU/min | (CFM) | (rpm) | (inches) | (inches) | inches^3 | (% at 150 psig) | (Watts) | (%) |
| 65 – 75 | | | | | 1500 - 3000 | | | | | | |
| 65 – 75 | | | | | | 1.5 - 2.25 | | | | | |
| 65 – 75 | | | | | | | 1.3 - 2 | | | | |
| 65 – 75 | | | | | | | | 2.3 - 8 | | | |
| 65 – 75 | | | | | | | | | 33 - 50 | | |
| 65 – 75 | | | | | | | | | | 1000-1800 | |
| 65 – 75 | 2.4 - 3.5 | 150 - 250 | 60 - 200 | 50 - 100 | | | | | | | 45 - 65 |
| 65 – 75 | | | | | 1500 - 3000 | 1.5 - 2.25 | | | | | |
| 65 – 75 | 2.4 - 3.5 | 150 - 250 | 60 - 200 | 50 - 100 | 1500 - 3000 | 1.5 - 2.25 | 1.3 - 2 | | | | |
| 65 – 75 | 2.4 - 3.5 | 150 - 250 | 60 - 200 | 50 - 100 | 1500 - 3000 | 1.5 - 2.25 | 1.3 - 2 | 2.3 - 8 | 33 - 50 | 1000-1800 | 45 - 65 |

FIG. 18

| Sound Level | Pump Air Delivery | Maximum Pressure | Heat Transfer Rate | Cooling Fan Flowrate | Pump Speed | Cylinder Bore | Stroke | Swept Volume | Volumetric Efficiency | Input Power | Motor Efficiency |
|---|---|---|---|---|---|---|---|---|---|---|---|
| (dBA) | (SCFM@90 psig) | (psig) | BTU/min | (CFM) | (rpm) | (inches) | (inches) | inches^3 | (% at 150 psig) | (Watts) | (%) |
| 70.5 | 2.9 | | | 71.5 | | | | | | | |
| 70.5 | 2.9 | | | | 2300 | 1.875 | 1.592 | | | | |
| 70.5 | 2.9 | | | | | | | 4.4 | 41 | | |
| 70.5 | 2.9 | | | | | | | | | 1446 | 56.5 |
| 70.5 | 2.9 | 200 | 84.1 | | | | | | | | |
| 70.5 | 2.9 | 200 | | 71.5 | | | | | | | |
| 70.5 | 2.9 | 200 | | | 2300 | 1.875 | 1.592 | | | | |
| 70.5 | 2.9 | 200 | | | | | | 4.4 | 41 | | |
| 70.5 | 2.9 | 200 | | | | | | | | 1446 | 56.5 |
| 70.5 | 2.9 | | 84.1 | | | | | | | | |
| 70.5 | 2.9 | | | 71.5 | | | | | | | |
| 70.5 | 2.9 | | | | 2300 | | | | | | |
| 70.5 | 2.9 | | | | | | | | | 1446 | |
| 70.5 | | 200 | 84.1 | | | | | | | | |
| 70.5 | | 200 | | 71.5 | | | | | | | |
| 70.5 | | 200 | | | 2300 | | | | | | |
| 70.5 | | 200 | | | | | | | | 1446 | |
| 70.5 | | | 84.1 | 71.5 | | | | | | | |
| 70.5 | | | 84.1 | | 2300 | | | | | | |
| 70.5 | | | | | | | | | | 1446 | |

FIG. 19

| Sound Level | Pump Air Delivery | Maximum Pressure | Heat Transfer Rate | Cooling Fan Flowrate | Pump Speed | Cylinder Bore | Stroke | Swept Volume | Volumetric Efficiency | Input Power | Motor Efficiency |
|---|---|---|---|---|---|---|---|---|---|---|---|
| (dBA) | (SCFM@90 psig) | (psig) | BTU/min | (CFM) | (rpm) | (inches) | (inches) | inches^3 | (% at 150 psig) | (Watts) | (%) |
| 70.5 | 2.9 | 200 | 84.1 | 71.5 | | | | | | | |
| 70.5 | 2.9 | 200 | 84.1 | | 2300 | | | | | | |
| 70.5 | 2.9 | 200 | 84.1 | 71.5 | 2300 | | | | | | |
| 70.5 | 2.9 | 200 | 84.1 | | | 1.875 | | | | | |
| 70.5 | 2.9 | 200 | 84.1 | | | | 1.592 | | | | |
| 70.5 | 2.9 | 200 | 84.1 | 71.5 | 2300 | | | | | | |
| 70.5 | 2.9 | 200 | 84.1 | 71.5 | 2300 | 1.875 | | | | | |
| 70.5 | 2.9 | 200 | 84.1 | 71.5 | 2300 | | 1.592 | | | | |
| 70.5 | 2.9 | 200 | 84.1 | 71.5 | 2300 | 1.875 | 1.592 | | | | |
| 70.5 | 2.9 | 200 | 84.1 | | | | | 4.4 | | | |
| 70.5 | 2.9 | 200 | 84.1 | | | | | | 41 | | |
| 70.5 | 2.9 | 200 | 84.1 | 71.5 | 2300 | 1.875 | 1.592 | 4.4 | | | |
| 70.5 | 2.9 | 200 | 84.1 | 71.5 | 2300 | 1.875 | 1.592 | 4.4 | 41 | | |
| 70.5 | 2.9 | 200 | 84.1 | | | | | | | 1446 | |
| 70.5 | 2.9 | 200 | 84.1 | | | | | | | | 56.5 |
| 70.5 | 2.9 | 200 | 84.1 | 71.5 | 2300 | 1.875 | 1.592 | 4.4 | 41 | 1446 | |
| 70.5 | 2.9 | 200 | 84.1 | 71.5 | 2300 | 1.875 | 1.592 | 4.4 | 41 | 1446 | 56.5 |

FIG. 20

| | Compressor Assembly Performance Data |
|---|---|
| Motor Speed (RPM) | 11200 |
| Pump Speed (RPM) | 2300 |
| Voltage | 120 |
| Air Flow (SCFM) @ 90 psi | 2.9 |
| Current Draw @ 90 psi (amps) | 11.8 |
| Volumetric Efficiency @ 90 psi | 49.6% |
| Motor Torque (lb-in) @ 90 psi | 6.01 |
| Motor Efficiency @ 90 psi | 56.3% |
| Air Flow (SCFM) @ 150 psi | 2.4 |
| Current Draw @ 150 psi (amps) | 12.05 |
| Volumetric Efficiency @ 150 psi | 41.0% |
| Motor Torque (lb-in) @ 150 psi | 6.16 |
| Motor Efficiency @ 150 psi | 56.5% |
| Air Flow (SCFM) @ 200 psi | 2.15 |
| Current Draw @ 200 psi (amps) | 11.88 |
| Volumetric Efficiency @ 200 psi | 36.7% |
| Motor Torque (lb-in) @ 200 psi | 6.06 |
| Motor Efficiency @ 200 psi | 56.4% |
| Cylinder Bore (inches) | 1.875 |
| Cylinder Stroke (inches) | 1.592 |
| Cylinder Swept Volume (cubic inches) | 4.40 |
| Sound Level (dBA) | 70.5 |
| Heat Transfer Rate (BTU/min) | 84.1 |

FIG. 21

| | Tiny Particle Size (μ) | Small Particle Size (μ) | Average Particle Size (μ) | Larger Particle Size (μ) |
|---|---|---|---|---|
| Drywall Dust | 0.75 | 1 | 3 | 5 |
| Sand | 60 | 100 | 5050 | 10000 |
| Saw Dust | 20 | 30 | 315 | 600 |
| Cement Dust | 1 | 3 | 52 | 100 |
| Airborne Liquid Droplets | 0.2 | 0.5 | 3 | 5 |
| Dry Clay | 0.05 | 0.1 | 25 | 50 |
| Atmospheric Dust | 0.00075 | 0.001 | 20 | 40 |
| Diatomaceous Earth | 5 | 7.5 | 20 | 200 |
| Airborne Paint | 4 | 7 | 20 | 10 |
| Graphite Brush Dust | 1 | 5 | 20 | 90 |
| Joint Compound | 0.5 | 1 | 20 | 5 |
| Airborne Liquid Water Droplets | 0.2 | 0.5 | 20 | 5 |

FIG. 29

| Material | Particle Size (microns, μ) | Density (g/cubic cm) | Mass (g) | Average Momentum (kg m/sec | Moment of Inertia (kg m2) |
|---|---|---|---|---|---|
| Sand | 100 to 10000 | 1.5900 | 8.33E−07 | 1.33E−08 | 8.33E−19 |
| Saw Dust | 30 to 600 | 0.2900 | 4.10E−09 | 6.55E−11 | 3.69E−22 |
| Graphite Brush Dust | 5 to 90 | 0.7700 | 5.04E−11 | 8.05E−13 | 1.26E−25 |
| Cement Dust | 3 to 100 | 0.8000 | 1.13E−11 | 1.81E−13 | 1.02E−26 |
| Joint Compound | 1 to 5 | 0.6410 | 3.36E−13 | 1.41E−15 | 3.36E−29 |
| Airborne Liquid Water Droplets | .5 to 5 | 0.998 | 6.53E−14 | 1.04E−15 | 1.63E−30 |
| Dry Clay | .1 to 50 | 0.8 | 4.19E−16 | 6.69E−18 | 4.19E−34 |
| Drywall Dust | .1 to 100 | 0.6410 | 3.36E−16 | 5.36E−18 | 3.36E−34 |

FIG. 30

COMPRESSOR INTAKE MUFFLER AND FILTER

CROSS-REFERENCE TO RELATED APPLICATIONS

This patent application is a continuation-in-part of and claims the benefit of the filing date of copending U.S. patent application Ser. No. 13/609,363 entitled "Compressor Intake Muffler And Filter" filed on Sep. 11, 2012, which issued as U.S. Pat. No. 8,770,341 Jul. 8, 2014.

U.S. patent application Ser. No. 13/609,363 (now U.S. Pat. No. 8,770,341) claims benefit of the filing date of U.S. provisional patent application No. 61/533,993 entitled "Air Ducting Shroud For Cooling An Air Compressor Pump And Motor" filed on Sep. 13, 2011. U.S. patent application Ser. No. 13/609,363 claims benefit of the filing date of U.S. provisional patent application No. 61/534,001 entitled "Shroud For Capturing Fan Noise" filed on Sep. 13, 2011. U.S. patent application Ser. No. 13/609,363 claims benefit of the filing date of U.S. provisional patent application No. 61/534,009 entitled "Method Of Reducing Air Compressor Noise" filed on Sep. 13, 2011. U.S. patent application Ser. No. 13/609,363 claims benefit of the filing date of U.S. provisional patent application No. 61/534,015 entitled "Tank Dampening Device" filed on Sep. 13, 2011. U.S. patent application Ser. No. 13/609,363 claims benefit of the filing date of U.S. provisional patent application No. 61/534,046 entitled "Compressor Intake Muffler And Filter" filed on Sep. 13, 2011.

FIELD OF THE INVENTION

The invention relates to a compressor for air, gas or gas mixtures.

INCORPORATION BY REFERENCE

This patent application incorporates by reference in its entirety copending U.S. patent application No. 13/609,363 entitled "Compressor Intake Muffler And Filter" filed on Sep. 11, 2012.

This patent application incorporates by reference in its entirety U.S. provisional patent application No. 61/533,993 entitled "Air Ducting Shroud For Cooling An Air Compressor Pump And Motor" filed on Sep. 13, 2011. This patent application incorporates by reference in its entirety U.S. provisional patent application No. 61/534,001 entitled "Shroud For Capturing Fan Noise" filed on Sep. 13, 2011. This patent application incorporates by reference in its entirety U.S. provisional patent application No. 61/534,009 entitled "Method Of Reducing Air Compressor Noise" filed on Sep. 13, 2011. This patent application incorporates by reference in its entirety U.S. provisional patent application No. 61/534,015 entitled "Tank Dampening Device" filed on Sep. 13, 2011. This patent application incorporates by reference in its entirety U.S. provisional patent application No. 61/534,046 entitled "Compressor Intake Muffler And Filter" filed on Sep. 13, 2011.

BACKGROUND OF THE INVENTION

Compressors are widely used in numerous applications. Existing compressors can generate a high noise output during operation. This noise can be annoying to users and can be distracting to those in the environment of compressor operation. Non-limiting examples of compressors which generate unacceptable levels of noise output include reciprocating, rotary screw and rotary centrifugal types. Compressors which are mobile or portable and not enclosed in a cabinet or compressor room can be unacceptably noisy. However, entirely encasing a compressor, for example in a cabinet or compressor room, is expensive, prevents mobility of the compressor and is often inconvenient or not feasible. Additionally, such encasement can create heat exchange and ventilation problems. There is a strong and urgent need for a quieter compressor technology.

When a power source for a compressor is electric, gas or diesel, unacceptably high levels of unwanted heat and exhaust gases can be produced. Additionally, existing compressors can be inefficient in cooling a compressor pump and motor. Existing compressors can use multiple fans, e.g. a compressor can have one fan associated with a motor and a different fan associated with a pump. The use of multiple fans adds cost manufacturing difficulty, noise and unacceptable complexity to existing compressors. Current compressors can also have improper cooling gas flow paths which can choke cooling gas flows to the compressor and its components. Thus, there is a strong and urgent need for a more efficient cooling design for compressors.

SUMMARY OF THE INVENTION

In an embodiment, a compressor assembly as disclosed herein can have a muffler for a feed air system of a compressor assembly. The muffler for a feed air system of a compressor assembly can have: an intake muffler feed line; a muffler outlet line and a muffler chamber wherein the intake muffler feed line is adapted to provide feed air to the muffler chamber and wherein the muffler outlet line is adapted to provide feed air from the muffler chamber for compression by a pump assembly.

A muffler for a feed air system of a compressor assembly can have a muffler chamber having a volume greater than 3 in^3. A muffler for a feed air system of a compressor assembly can have a muffler chamber having a volume greater than 10 in^3. A muffler for a feed air system of a compressor assembly can have a muffler chamber having a volume greater than 30 in^3.

A muffler for a feed air system of a compressor assembly can have a muffler chamber which is the product of a blow molding process. A muffler for a feed air system of a compressor assembly can have a muffler chamber having a substantially curved surface area.

A muffler for a feed air system of a compressor assembly can have a muffler chamber having a first internal chord which is greater than 1.5 times the length of a second internal chord. A muffler for a feed air system of a compressor assembly can have a muffler having an angle in the intake muffler feed line which has a value in the range of from 33 degrees to 156 degrees. A muffler for a feed air system of a compressor assembly can have a muffler having an angle in the muffler outlet line which has a value in the range of from 33 degrees to 156 degrees.

A muffler for a feed air system of a compressor assembly can have a muffler having a muffler inlet centerline and a muffler outlet centerline which cross at an angle in a range of from 66 degrees to 156 degrees. A muffler for a feed air system of a compressor assembly can have a muffler having a muffler inlet centerline and a muffler outlet centerline which are perpendicular to each other. A muffler for a feed air system of a compressor assembly can have a muffler having a head feed centerline and a muffler intake centerline which are at an angle in a range of from 66 degrees to 156 degrees to each other. A muffler for a feed air system of a compressor assembly can have a muffler having a head feed centerline and a muffler intake centerline which are at an angle of 146 degrees to each other.

In an aspect, a sound level of a compressor assembly can be controlled by a method of sound control for a compressor assembly, having the steps of: providing a feed air; providing an intake muffler having an outlet in communication with an inlet of a pump assembly adapted to compress the feed air; feeding the feed air through the muffler and into the pump assembly; and compressing the feed air at a compressor assembly sound level in a range of from 65 dBA to 75 dBA.

The method of sound control for a compressor assembly can have a step of compressing the feed air at a volumetric rate in a range of from 2.4 SCFM to 3.5 SCFM.

The method of sound control for a compressor assembly can have a step of compressing the feed air to a pressure in a range of from 150 to 250 psig.

The method of sound control for a compressor assembly can have a step of compressing the feed air at a volumetric rate in a range of from 2.4 SCFM to 3.5 SCFM and to a pressure in a range of from 150 to 250 psig. The method of sound control for a compressor assembly, can have a step of cooling the compressor assembly using a cooling air flow rate of from 3.5 SCFM to 100 SCFM.

The method of sound control for a compressor assembly can have a step of cooling the compressor assembly at a rate of from 60 BTU/min to 200 BTU/min.

In an embodiment, a compressor assembly can have a means for sound control of a feed air path which uses a means for dampening sound emitted from a pump system through the feed air path.

In an embodiment, the compressor assembly can have a muffler system having an inertia filter and a muffler chamber. The inertia filter can filter a gas which can be fed to the muffler chamber and which can exit the muffler chamber for compression by a pump assembly. In an embodiment, the gas can be air. The inertia filter can be selected from various embodiments, such as a T-inertia filter, a stepped inertia filter, a recessed inertia filter, or other design which filters particles based upon the particles' inertia. The inertia filter can have an inertia filter feed angle in a range of 15° to 90°. In an embodiment, the inertia filter can have a counterflow feed. Optionally, the compressor assembly can have an inertia filter baffle.

In an embodiment, the muffler chamber can be free of a filter medium. Further, the muffler system can have at least one of a muffler feed line and muffler outlet line which has an inner diameter which is in a range of 5% to 75% of a diameter and/or dimension of the muffler chamber.

The compressor assembly can use a method for producing a compressor pump feed having the steps of: providing a compressor pump assembly having an inertia filter, a muffler and a compressor pump; filtering a gas by inertia filtering to produce a muffler feed; feeding the muffler feed to the muffler; and feeding a muffler effluent to the compressor pump. The method for producing a compressor pump feed can have the step of feeding the muffler feed to the muffler at a rate of 1.5 SCFM or greater. The method for producing a compressor pump feed can further have the step of filtering particles having a dimension greater than 1μ. The method for producing a compressor pump feed can further have the step of filtering particles having a momentum of greater than 6.69×10−18 kg*m/sec. The method for producing a compressor pump feed can further have the step of filtering particles having an inertia of greater than 4.19×10−34 kg*m^2.

The method for producing a compressor pump feed can use an inertia filter which is any of a variety of designs including, but not limited to, a T-inertia filter, a stepped inertia filter and a recessed inertia filter.

A method for producing a compressed gas can have the steps of: providing a compressor assembly having an inertia filter, a muffler and a compressor pump; filtering a gas feed stream through the inertia filter to produce a muffler feed; feeding the muffler feed to the muffler to produce a compressor pump feed; and compressing the compressor pump feed to a pressure greater than 25 PSIG by the compressor pump. In an embodiment, the method for producing a compressed gas, can further have the step of compressing the compressor pump feed at a rate of 1.5 SCFM or greater and can produce noise from the compressor assembly which is in a range of 60 dBA to 75 dBA when compressing the compressor pump feed.

BRIEF DESCRIPTION OF THE DRAWINGS

The present invention in its several aspects and embodiments solves the problems discussed above and significantly advances the technology of compressors. The present invention can become more fully understood from the detailed description and the accompanying drawings, wherein:

FIG. 17 is a first table of embodiments of compressor assembly ranges of performance characteristics;

FIG. 18 is a second table of embodiments of compressor assembly ranges of performance characteristics;

FIG. 19 is a first table of example performance characteristics for an example compressor assembly;

FIG. 20 is a second table of example performance characteristics for an example compressor assembly;

FIG. 21 is a table containing a third example of performance characteristics of an example compressor assembly;

FIG. 29 is a table of filtered particle size distribution data;

FIG. 30 is a table of filtered particle moment of inertia data.

Herein, like reference numbers in one figure refer to like reference numbers in another figure.

DETAILED DESCRIPTION OF THE INVENTION

Figure 2:
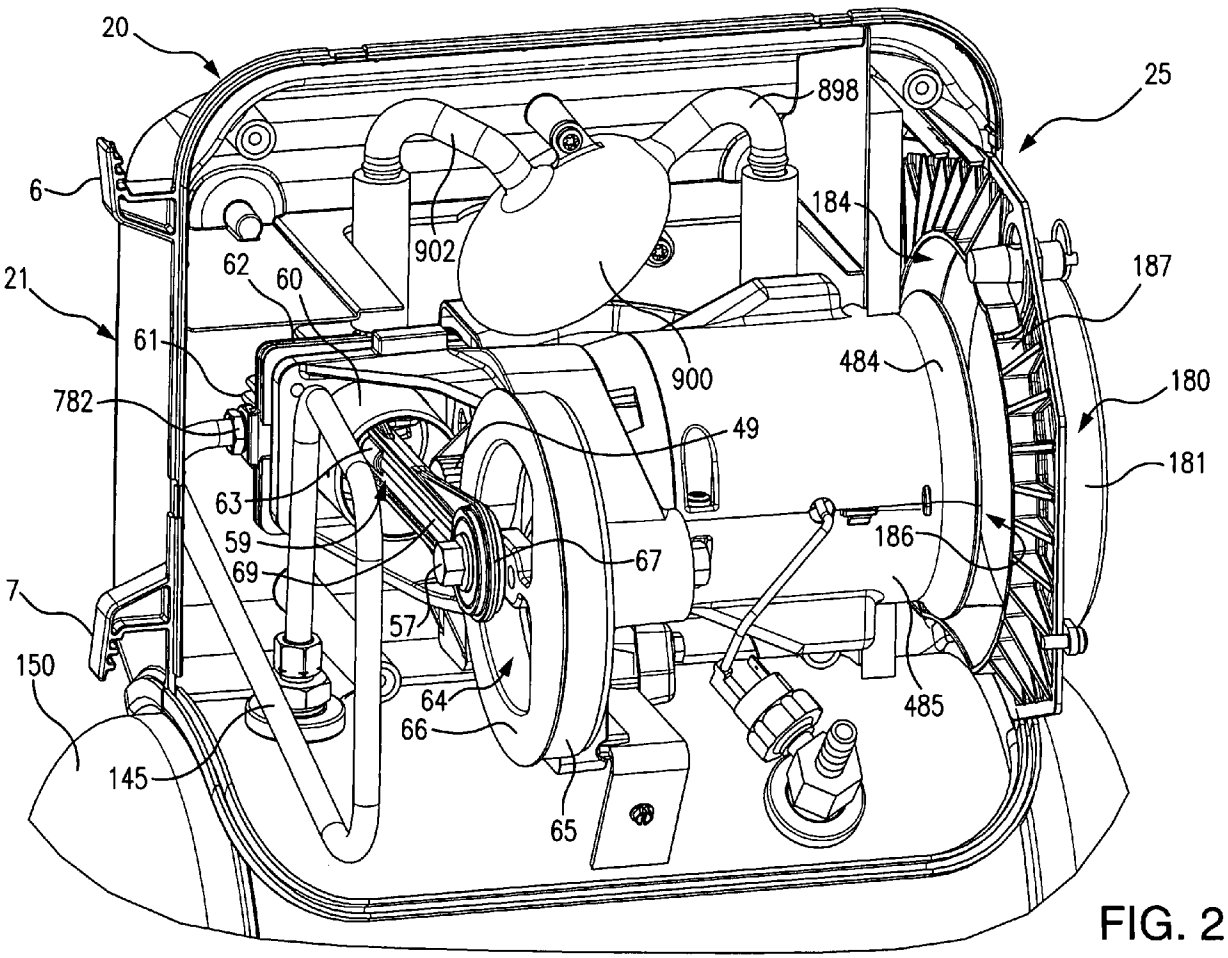
FIG. 2 is a front view of internal components of the compressor assembly.
Figure 3:
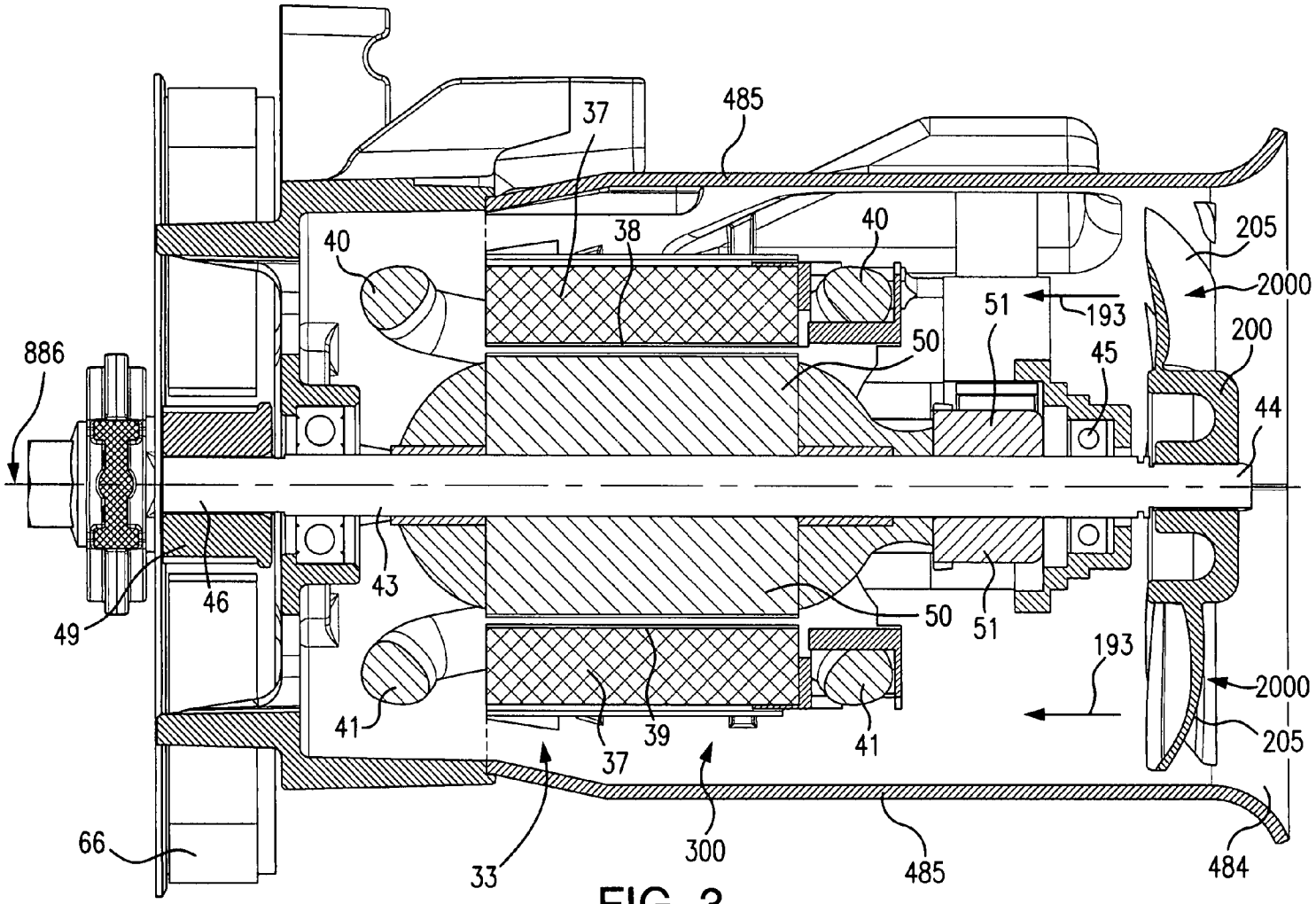
FIG. 3 is a front sectional view of the motor and fan assembly.
Figure 4:
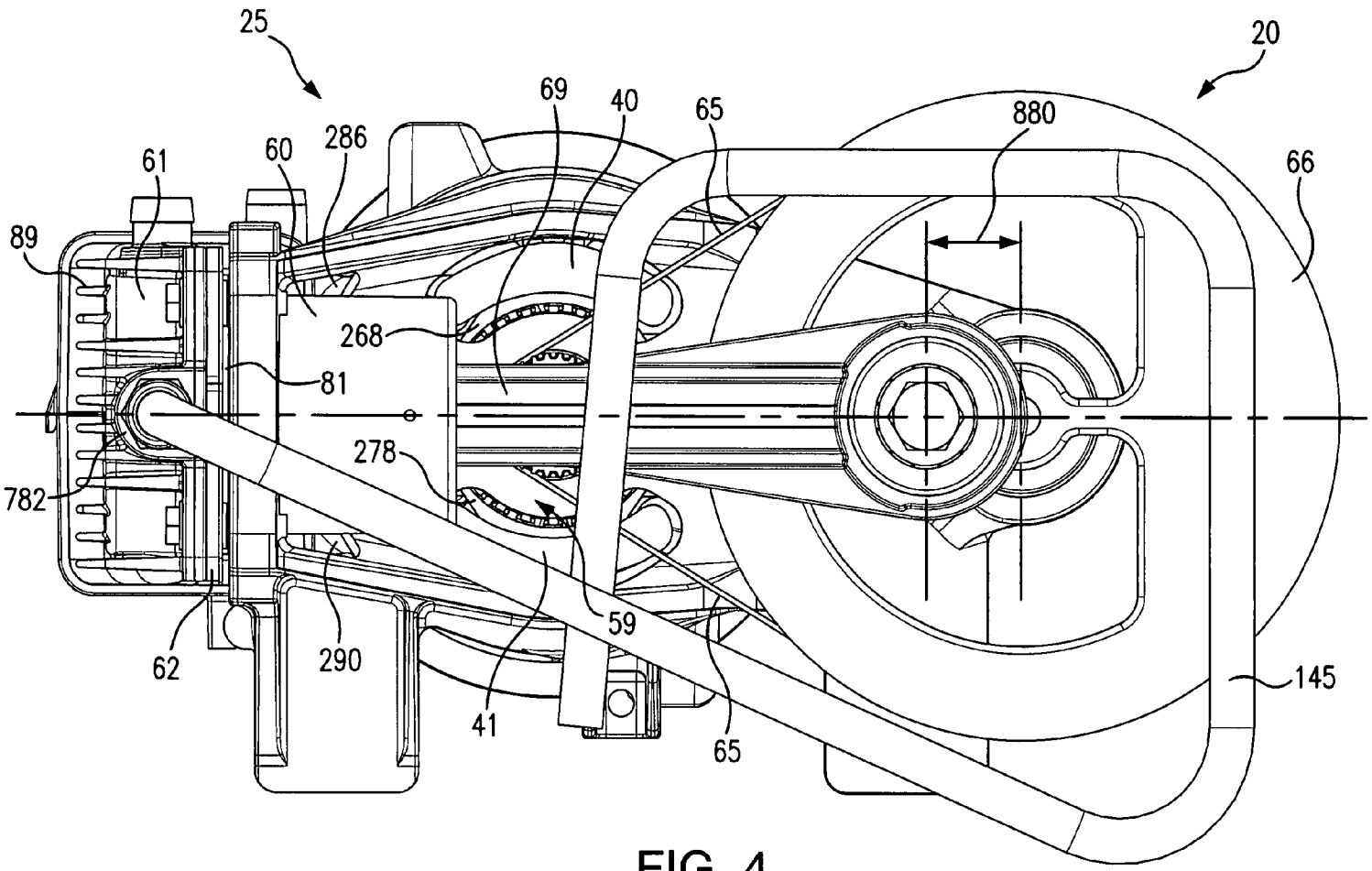
FIG. 4 is a pump-side view of components of the pump assembly.

The invention relates to a compressor assembly which can compress air, or gas, or gas mixtures, and which has a low noise output, effective cooling means and high heat transfer. The inventive compressor assembly achieves efficient cooling of the compressor assembly 20 (FIG. 1) and/or pump assembly 25 (FIG. 2) and/or the components thereof (FIGS. 3 and 4). In an embodiment, the compressor can compress air. In another embodiment, the compressor can compress one or more gases, inert gases, or mixed gas compositions. The disclosure herein regarding compression of air is also applicable to the use of the disclosed apparatus in its many embodiments and aspects in a broad variety of services and can be used to compress a broad variety of gases and gas mixtures.

Figure 1:
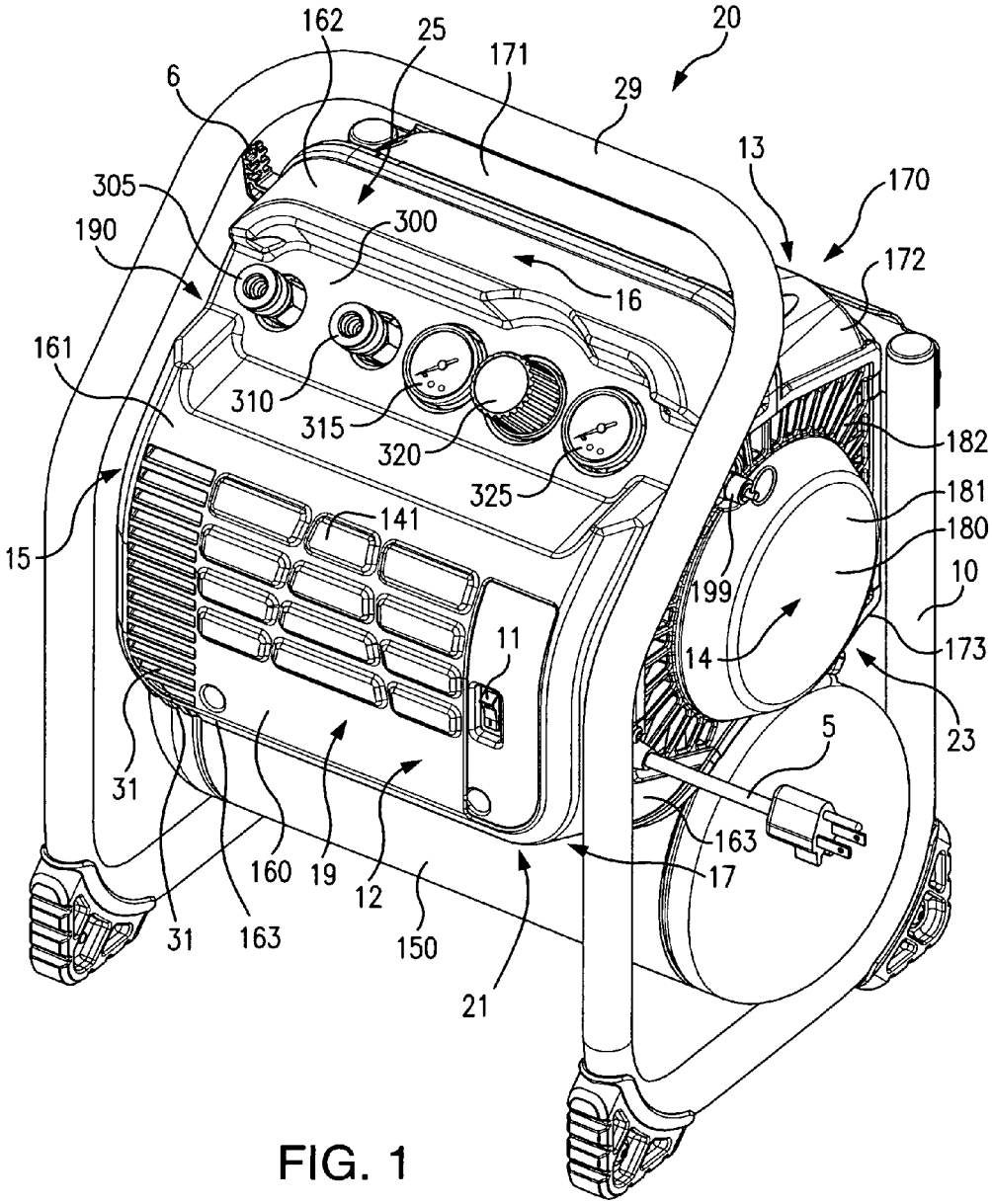
FIG. 1 is a perspective view of a compressor assembly.

FIG. 1 is a perspective view of a compressor assembly 20 shown according to the invention. In an embodiment, the compressor assembly 20 can compress air, or can compress one or more gases, or gas mixtures. In an embodiment, the compressor assembly 20 is also referred to hearing herein as "a gas compressor assembly" or "an air compressor assembly".

The compressor assembly 20 can optionally be portable. The compressor assembly 20 can optionally have a handle 29, which optionally can be a portion of frame 10.

In an embodiment, the compressor assembly 20 can have a value of weight between 15 lbs and 100 lbs. In an embodiment, the compressor assembly 20 can be portable and can have a value of weight between 15 lbs and 50 lbs. In an embodiment, the compressor assembly 20 can have a value of weight between 25 lbs and 40 lbs. In an embodiment, the compressor assembly 20 can have a value of weight of, e.g. 38 lbs, or 29 lbs, or 27 lbs, or 25 lbs, or 20 lbs, or less. In an embodiment, frame 10 can have a value of weight of 10 lbs or less. In an embodiment, frame 10 can weigh 5 lbs, or less, e.g. 4 lbs, or 3 lbs, of 2 lbs, or less.

In an embodiment, the compressor assembly 20 can have a front side 12 ("front"), a rear side 13 ("rear"), a fan side 14 ("fan-side"), a pump side 15 ("pump-side"), a top side 16 ("top") and a bottom side 17 ("bottom").

The compressor assembly 20 can have a housing 21 which can have ends and portions which are referenced herein by orientation consistently with the descriptions set forth above. In an embodiment, the housing 21 can have a front housing 160, a rear housing 170, a fan-side housing 180 and a pump-side housing 190. The front housing 160 can have a front housing portion 161, a top front housing portion 162 and a bottom front housing potion 163. The rear housing 170 can have a rear housing portion 171, a top rear housing portion 172 and a bottom rear housing portion 173. The fan-side housing 180 can have a fan cover 181 and a plurality of intake ports 182. The compressor assembly can be cooled by air flow provided by a fan 200 (FIG. 3), e.g. cooling air stream 2000 (FIG. 3).

In an embodiment, the housing 21 can be compact and can be molded. The housing 21 can have a construction at least in part of plastic, or polypropylene, acrylonitrile butadiene styrene (ABS), metal, steel, stamped steel, fiberglass, thermoset plastic, cured resin, carbon fiber, or other material. The frame 10 can be made of metal, steel, aluminum, carbon fiber, plastic or fiberglass.

Power can be supplied to the motor of the compressor assembly through a power cord 5 extending through the fan-side housing 180. In an embodiment, the compressor assembly 20 can comprise one or more of a cord holder member, e.g. first cord wrap 6 and second cord wrap 7 (FIG. 2).

In an embodiment, power switch 11 can be used to change the operating state of the compressor assembly 20 at least from an "on" to an "off" state, and vice versa. In an "on" state, the compressor can be in a compressing state (also herein as a "pumping state") in which it is compressing air, or a gas, or a plurality of gases, or a gas mixture.

Figure 7:
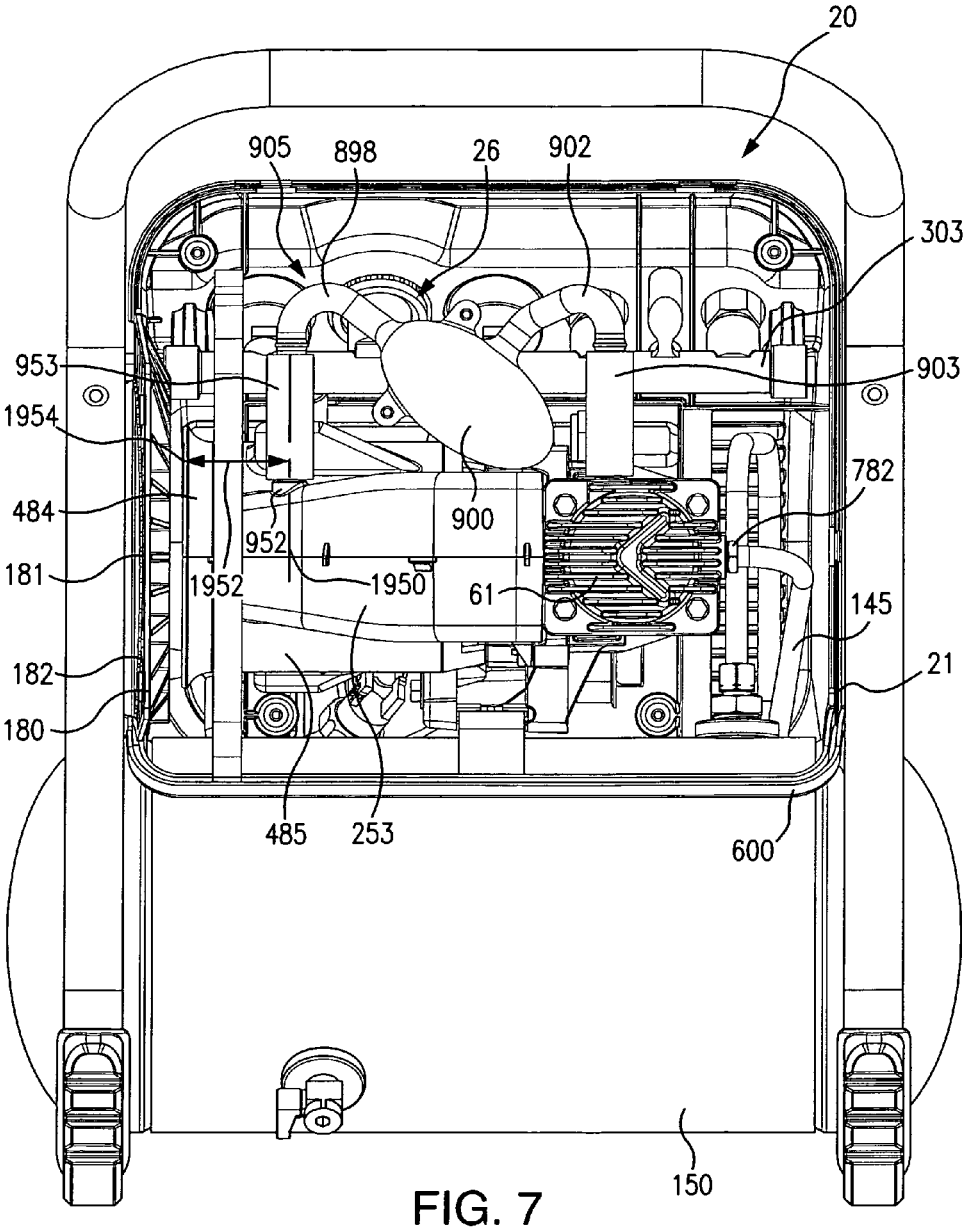
FIG. 7 is a rear view of internal components of the compressor assembly.

In an embodiment, other operating modes can be engaged by power switch 11 or a compressor control system, e.g. a standby mode, or a power save mode. In an embodiment, the front housing 160 can have a dashboard 300 which provides an operator-accessible location for connections, gauges and valves which can be connected to a manifold 303 (FIG. 7). In an embodiment, the dashboard 300 can provide an operator access in non-limiting example to a first quick connection 305, a second quick connection 310, a regulated pressure gauge 315, a pressure regulator 320 and a tank pressure gauge 325. In an embodiment, a compressed gas outlet line, hose or other device to receive compressed gas can be connected the first quick connection 305 and/or second quick connection 310. In an embodiment, as shown in FIG. 1, the frame can be configured to provide an amount of protection to the dashboard 300 from the impact of objects from at least the pump-side, fan-side and top directions.

In an embodiment, the pressure regulator 320 employs a pressure regulating valve. The pressure regulator 320 can be used to adjust the pressure regulating valve 26 (FIG. 7). The pressure regulating valve 26 can be set to establish a desired output pressure. In an embodiment, excess air pressure can be can vented to atmosphere through the pressure regulating valve 26 and/or pressure relief valve 199 (FIG. 1). In an embodiment, pressure relief valve 199 can be a spring loaded safety valve. In an embodiment, the air compressor assembly 20 can be designed to provide an unregulated compressed air output.

In an embodiment, the pump assembly 25 and the compressed gas tank 150 can be connected to frame 10. The pump assembly 25, housing 21 and compressed gas tank 150 can be connected to the frame 10 by a plurality of screws and/or one or a plurality of welds and/or a plurality of connectors and/or fasteners.

The plurality of intake ports 182 can be formed in the housing 21 adjacent the housing inlet end 23 and a plurality of exhaust ports 31 can be formed in the housing 21. In an embodiment, the plurality of the exhaust ports 31 can be placed in housing 21 in the front housing portion 161. Optionally, the exhaust ports 31 can be located adjacent to the pump end of housing 21 and/or the pump assembly 25 and/or the pump cylinder 60 and/or cylinder head 61 (FIG. 2) of the pump assembly 25. In an embodiment, the exhaust ports 31 can be provided in a portion of the front housing portion 161 and in a portion of the bottom front housing portion 163.

The total cross-sectional open area of the intake ports 182 (the sum of the cross-sectional areas of the individual intake ports 182) can be a value in a range of from 3.0 in^2 to 100 in^2. In an embodiment, the total cross-sectional open area of the intake ports 182 can be a value in a range of from 6.0 in^2 to 38.81 in^2. In an embodiment, the total cross-sectional open area of the intake ports 182 can be a value in a range of from 9.8 in^2 to 25.87 in^2. In an embodiment, the total cross-sectional open area of the intake ports 182 can be 12.936 in^2.

In an embodiment, the cooling gas employed to cool compressor assembly 20 and its components can be air (also known herein as "cooling air"). The cooling air can be taken in from the environment in which the compressor assembly 20 is placed. The cooling air can be ambient from the natural environment, or air which has been conditioned or treated. The definition of "air" herein is intended to be very broad. The term "air" includes breathable air, ambient air, treated air, conditioned air, clean room air, cooled air, heated air, non-flammable oxygen containing gas, filtered air, purified air, contaminated air, air with particulates solids or water, air from bone dry (i.e. 0.00 humidity) air to air which is supersaturated with water, as well as any other type of air present in an environment in which a gas (e.g. air) compressor can be used. It is intended that cooling gases which are not air are encompassed by this disclosure. For non-limiting example, a cooling gas can be nitrogen, can comprise a gas mixture, can comprise nitrogen, can comprise oxygen (in a safe concentration), can comprise carbon dioxide, can comprise one inert gas or a plurality of inert gases, or comprise a mixture of gases.

In an embodiment, cooling air can be exhausted from compressor assembly 20 through a plurality of exhaust ports 31. The total cross-sectional open area of the exhaust ports 31 (the sum of the cross-sectional areas of the individual exhaust ports 31) can be a value in a range of from 3.0 in^2 to 100 in^2. In an embodiment, the total cross-sectional open area of the exhaust ports can be a value in a range of from 3.0 in^2 to 77.62 in^2. In an embodiment, the total cross-sectional open area of the exhaust ports can be a value in a range of from 4.0 in^2 to 38.81 in^2. In an embodiment, the total cross-sectional open area of the exhaust ports can be a value in a range of from 4.91 in^2 to 25.87 in^2. In an embodiment, the total cross-sectional open area of the exhaust ports can be 7.238 in^2.

Numeric values and ranges herein, unless otherwise stated, also are intended to have associated with them a tolerance and to account for variances of design and manufacturing, and/or operational and performance fluctuations. Thus, a number disclosed herein is intended to disclose values "about" that number. For example, a value X is also intended to be understood as "about X". Likewise, a range of Y-Z, is also intended to be understood as within a range of from "about Y-about Z". Unless otherwise stated, significant digits disclosed for a number are not intended to make the number an exact limiting value. Variance and tolerance, as well as operational or performance fluctuations, are an expected aspect of mechanical design and the numbers disclosed herein are intended to be construed to allow for such factors (in non-limiting e.g., ±10 percent of a given value). This disclosure is to be broadly construed. Likewise, the claims are to be broadly construed in their recitations of numbers and ranges.

The compressed gas tank 150 can operate at a value of pressure in a range of at least from ambient pressure, e.g. 14.7 psig to 3000 psig ("psig" is the unit lbf/in^2 gauge), or greater. In an embodiment, compressed gas tank 150 can operate at 200 psig. In an embodiment, compressed gas tank 150 can operate at 150 psig.

In an embodiment, the compressor has a pressure regulated on/off switch which can stop the pump when a set pressure is obtained. In an embodiment, the pump is activated when the pressure of the compressed gas tank 150 falls to 70 percent of the set operating pressure, e.g. to activate at 140 psig with an operating set pressure of 200 psig (140 psig=0.70*200 psig). In an embodiment, the pump is activated when the pressure of the compressed gas tank 150 falls to 80 percent of the set operating pressure, e.g. to activate at 160 psig with an operating set pressure of 200 psig (160 psig =0.80*200 psig). Activation of the pump can occur at a value of pressure in a wide range of set operating pressure, e.g. 25 percent to 99.5 percent of set operating pressure. Set operating pressure can also be a value in a wide range of pressure, e.g. a value in a range of from 25 psig to 3000 psig. An embodiment of set pressure can be 50 psig, 75 psig, 100 psig, 150 psig, 200 psig, 250 psig, 300 psig, 500 psig, 1000 psig, 2000 psig, 3000 psig, or greater than or less than, or a value in between these example numbers.

The compressor assembly 20 disclosed herein in its various embodiments achieves a reduction in the noise created by the vibration of the air tank while the air compressor is running, in its compressing state (pumping state) e.g. to a value in a range of from 60-75 dBA, or less, as measured by ISO3744-1995. Noise values discussed herein are compliant with ISO3744-1995. ISO3744-1995 is the standard for noise data and results for noise data, or sound data, provided in this application. Herein "noise" and "sound" are used synonymously.

The pump assembly 25 can be mounted to an air tank and can be covered with a housing 21. A plurality of optional decorative shapes 141 can be formed on the front housing portion 161. The plurality of optional decorative shapes 141 can also be sound absorbing and/or vibration dampening shapes. The plurality of optional decorative shapes 141 can optionally be used with, or contain at least in part, a sound absorbing material.

FIG. 2 is a front view of internal components of the compressor assembly.

The compressor assembly 20 can include a pump assembly 25. In an embodiment, pump assembly 25 which can compress a gas, air or gas mixture. In an embodiment in which the pump assembly 25 compresses air, it is also referred to herein as air compressor 25, or compressor 25. In an embodiment, the pump assembly 25 can be powered by a motor 33 (e.g. FIG. 3).

FIG. 2 illustrates the compressor assembly 20 with a portion of the housing 21 removed and showing the pump assembly 25. In an embodiment, the fan-side housing 180 can have a fan cover 181 and a plurality of intake ports 182. The cooling gas, for example air, can be fed through an air inlet space 184 which feeds air into the fan 200 (e.g. FIG. 3). In an embodiment, the fan 200 can be housed proximate to an air intake port 186 of an air ducting shroud 485.

Air ducting shroud 485 can have a shroud inlet scoop 484. As illustrated in FIG. 2, air ducting shroud 485 is shown encasing the fan 200 and the motor 33 (FIG. 3). In an embodiment, the shroud inlet scoop 484 can encase the fan 200, or at least a portion of the fan and at least a portion of motor 33. In this embodiment, an air inlet space 184 which feeds air into the fan 200 is shown. The air ducting shroud 485 can encase the fan 200 and the motor 33, or at least a portion of these components.

FIG. 2 is an intake muffler 900 which can receive feed air for compression (also herein as "feed air 990"; e.g. FIG. 8) via the intake muffler feed line 898. The feed air 990 can pass through the intake muffler 900 and be fed to the cylinder head 61 via the muffler outlet line 902. The feed air 990 can be compressed in pump cylinder 60 by piston 63. The piston can be provided with a seal which can function, such as slide, in the cylinder without liquid lubrication. The cylinder head 61 can be shaped to define an inlet chamber 81 (e.g. FIG. 9) and an outlet chamber 82 (e.g. FIG. 8) for a compressed gas, such as air (also known herein as "compressed air 999" or "compressed gas 999"; e.g. FIG. 10). In an embodiment, the pump cylinder 60 can be used as at least a portion of an inlet chamber 81. A gasket can form an air tight seal between the cylinder head 61 and the valve plate assembly 62 to prevent a leakage of a high pressure gas, such as compressed air 999, from the outlet chamber 82. Compressed air 999 can exit the cylinder head 61 via a compressed gas outlet port 782 and can pass through a compressed gas outlet line 145 to enter the compressed gas tank 150.

Figure 9:
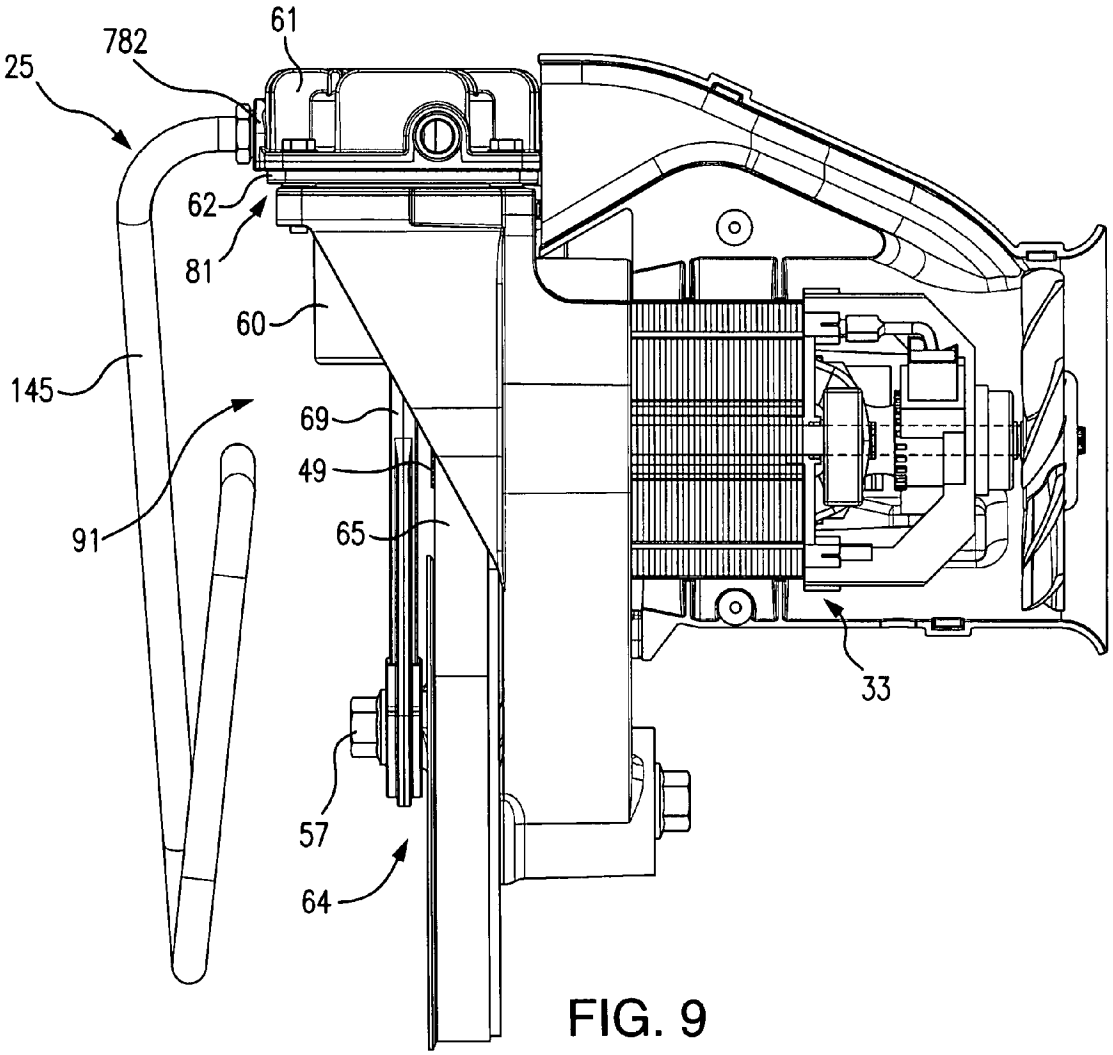
FIG. 9 is a top view of components of the pump assembly.

As shown in FIG. 2, the pump assembly 25 can have a pump cylinder 60, a cylinder head 61, a valve plate assembly 62 mounted between the pump cylinder 60 and the cylinder head 61, and a piston 63 which is reciprocated in the pump cylinder 60 by an eccentric drive 64 (e.g. FIG. 9). The eccentric drive 64 can include a sprocket 49 which can drive a drive belt 65 which can drive a pulley 66. A bearing 67 can be eccentrically secured to the pulley 66 by a screw, or a rod bolt 57, and a connecting rod 69. Preferably, the sprocket 49 and the pulley 66 can be spaced around their perimeters and the drive belt 65 can be a timing belt. The pulley 66 can be mounted about pulley centerline 887 and linked to a sprocket 49 by the drive belt 65 (FIG. 3) which can be configured on an axis which is represent herein as a shaft centerline 886 supported by a bracket and by a bearing 47 (FIG. 3). A bearing can allow the pulley 66 to be rotated about an axis 887 (FIG. 10) when the motor rotates the sprocket 49. As the pulley 66 rotates about the axis 887 (FIG. 10), the bearing 67 (FIG. 2) and an attached end of the connecting rod 69 are moved around a circular path.

The piston 63 can be formed as an integral part of the connecting rod 69. A compression seal can be attached to the piston 63 by a retaining ring and a screw. In an embodiment, the compression seal can be a sliding compression seal.

A cooling gas stream, such as cooling air stream 2000 (FIG. 3), can be drawn through intake ports 182 to feed fan 200. The cooling air stream 2000 can be divided into a number of different cooling air stream flows which can pass through portions of the compressor assembly and exit separately, or collectively as an exhaust air steam through the plurality of exhaust ports 31. Additionally, the cooling gas, e.g. cooling air stream 2000, can be drawn through the plurality of intake ports 182 and directed to cool the internal components of the compressor assembly 20 in a predetermined sequence to optimize the efficiency and operating life of the compressor assembly 20. The cooling air can be heated by heat transfer from compressor assembly 20 and/or the components thereof, e.g. pump assembly 25 (FIG. 3). The heated air can be exhausted through the plurality of exhaust ports 31.

In an embodiment, one fan can be used to cool both the pump and motor. A design using a single fan to provide cooling to both the pump and motor can require less air flow than a design using two or more fans, e.g. using one or more fans to cool the pump, and also using one or more fans to cool the motor. Using a single fan to provide cooling to both the pump and motor can reduce power requirements and also reduces noise production as compared to designs using a plurality of fans to cool the pump and the motor, or which use a plurality of fans to cool the pump assembly 25, or the compressor assembly 20.

In an embodiment, the fan blade 205 (e.g. FIG. 3) establishes a forced flow of cooling air through the internal housing, such as the air ducting shroud 485. The cooling air flow through the air ducting shroud can be a volumetric flow rate having a value of between 25 CFM to 400 CFM. The cooling air flow through the air ducting shroud can be a volumetric flow rate having a value of between 45 CFM to 125 CFM.

In an embodiment, the outlet pressure of cooling air from the fan can be in a range of from 1 psig to 50 psig. In an embodiment, the fan 200 can be a low flow fan with which generates an outlet pressure having a value in a range of from 1 inch of water to 10 psi. In an embodiment, the fan 200 can be a low flow fan with which generates an outlet pressure having a value in a range of from 2 in of water to 5 psi.

In an embodiment, the air ducting shroud 485 can flow 100 CFM of cooling air with a pressure drop of from 0.0002 psi to 50 psi along the length of the air ducting shroud. In an embodiment, the air ducting shroud 485 can flow 75 CFM of cooling air with a pressure drop of 0.028 psi along its length as measured from the entrance to fan 200 through the exit from conduit 253 (FIG. 7).

In an embodiment, the air ducting shroud 485 can flow 75 CFM of cooling air with a pressure drop of 0.1 psi along its length as measured from the outlet of fan 200 through the exit from conduit 253. In an embodiment, the air ducting shroud 485 can flow 100 CFM of cooling air with a pressure drop of 1.5 psi along its length as measured from the outlet of fan 200 through the exit from conduit 253. In an embodiment, the air ducting shroud 485 can flow 150 CFM of cooling air with a pressure drop of 5.0 psi along its length as measured from the outlet of fan 200 through the exit from conduit 253.

In an embodiment, the air ducting shroud 485 can flow 75 CFM of cooling air with a pressure drop in a range of from 1.0 psi to 30 psi across as measured from the outlet of fan 200 across the motor 33.

Depending upon the compressed gas output, the design rating of the motor 33 and the operating voltage, in an embodiment, the motor 33 can operate at a value of rotation (motor speed) between 5,000 rpm and 20,000 rpm. In an embodiment, the motor 33 can operate at a value in a range of between 7,500 rpm and 12,000 rpm. In further embodiments, the motor 33 can operate at e.g. 11,252 rpm, or 11,000 rpm; or 10,000 rpm; or 9,000 rpm; or 7,500 rpm; or 6,000 rpm; or 5,000 rpm. The pulley 66 and the sprocket 49 can be sized to achieve reduced pump speeds (also herein as "reciprocation rates", or "piston speed") at which the piston 63 is reciprocated. For example, if the sprocket 49 can have a diameter of 1 in and the pulley 66 can have a diameter of 4 in, then a motor 33 speed of 14,000 rpm can achieve a reciprocation rate, or a piston speed, of 3,500 strokes per minute. In an embodiment, if the sprocket 49 can have a diameter of 1.053 in and the pulley 66 can have a diameter of 5.151 in, then a motor 33 speed of 11,252 rpm can achieve a reciprocation rate, or a piston speed (pump speed), of 2,300 strokes per minute.

FIG. 3 is a front sectional view of the motor and fan assembly.

FIG. 3 illustrates the fan 200 and motor 33 covered by air ducting shroud 485. The fan 200 is shown proximate to a shroud inlet scoop 484.

The motor can have a stator 37 with an upper pole 38 around which upper stator coil 40 is wound and/or configured. The motor can have a stator 37 with a lower pole 39 around which lower stator coil 41 is wound and/or configured. A shaft 43 can be supported adjacent a first shaft end 44 by a bearing 45 and is supported adjacent to a second shaft end 46 by a bearing 47. A plurality of fan blades 205 can be secured to the fan 200 which can be secured to the first shaft end 44. When power is applied to the motor 33, the shaft 43 rotates at a high speed to in turn drive the sprocket 49 (FIG. 2), the drive belt 65 (FIG. 4), the pulley 66 (FIG. 4) and the fan blade 200. In an embodiment, the motor can be a non-synchronous universal motor. In an embodiment, the motor can be a synchronous motor used.

The compressor assembly 20 can be designed to accommodate a variety of types of motor 33. The motors 33 can come from different manufacturers and can have horsepower ratings of a value in a wide range from small to very high. In an embodiment, a motor 33 can be purchased from the existing market of commercial motors. For example, although the housing 21 is compact, In an embodiment, it can accommodate a universal motor, or other motor type, rated, for example, at ½ horsepower, at ¾ horsepower or 1 horsepower by scaling and/or designing the air ducting shroud 485 to accommodate motors in a range from small to very large.

FIG. 3 and FIG. 4 illustrate the compression system for the compressor which is also referred to herein as the pump assembly 25. The pump assembly 25 can have a pump 59, a pulley 66, drive belt 65 and driving mechanism driven by motor 33. The connecting rod 69 can connect to a piston 63 (e.g. FIG. 10) which can move inside of the pump cylinder 60.

In one embodiment, the pump 59 such as "gas pump" or "air pump" can have a piston 63, a pump cylinder 60, in which a piston 63 reciprocates and a cylinder rod 69 (FIG. 2) which can optionally be oil-less and which can be driven to compress a gas, e.g. air. The pump 59 can be driven by a high speed universal motor, e.g. motor 33 (FIG. 3), or other type of motor.

FIG. 4 is a pump-side view of components of the pump assembly 25. The "pump assembly 25" can have the components which are attached to the motor and/or which serve to compress a gas; which in non-limiting example can comprise the fan, the motor 33, the pump cylinder 60 and piston 63 (and its driving parts), the valve plate assembly 62, the cylinder head 61 and the outlet of the cylinder head 782. Herein, the feed air system 905 system (FIG. 7) is referred to separately from the pump assembly 25.

FIG. 4 illustrates that pulley 66 is driven by the motor 33 using drive belt 65.

FIG. 4 (also see FIG. 10) illustrates an offset 880 which has a value of distance which represents one half (½) of the stroke distance. The offset 880 can have a value between 0.25 in and 6 in, or larger. In an embodiment, the offset 880 can have a value between 0.75 in and 3 in. In an embodiment, the offset 880 can have a value between 1.0 in and 2 in, e.g. 1.25 in. In an embodiment, the offset 880 can have a value of about 0.796 in. In an embodiment, the offset 880 can have a value of about 0.5 in. In an embodiment, the offset 880 can have a value of about 1.5 in.

A stroke having a value in a range of from 0.50 in and 12 in, or larger can be used. A stroke having a value in a range of from 1.5 in and 6 in can be used. A stroke having a value in a range of from 2 in and 4 in can be used. A stroke of 2.5 in can be used. In an embodiment, the stroke can be calculated to equal two (2) times the offset, for example, an offset 880 of 0.796 produces a stroke of 2(0.796)=1.592 in. In another example, an offset 880 of 2.25 produces a stroke of 2(2.25)=4.5 in. In yet another example, an offset 880 of 0.5 produces a stroke of 2(0.5)=1.0 in.

The compressed air passes through valve plate assembly 62 and into the cylinder head 61 having a plurality of cooling fins 89. The compressed gas is discharged from the cylinder head 61 through the outlet line 145 which feeds compressed gas to the compressed gas tank 150.

FIG. 4 also identifies the pump-side of upper motor path 268 which can provide cooling air to upper stator coil 40 and lower motor path 278 which can provide cooling to lower stator coil 41.

Figure 5:
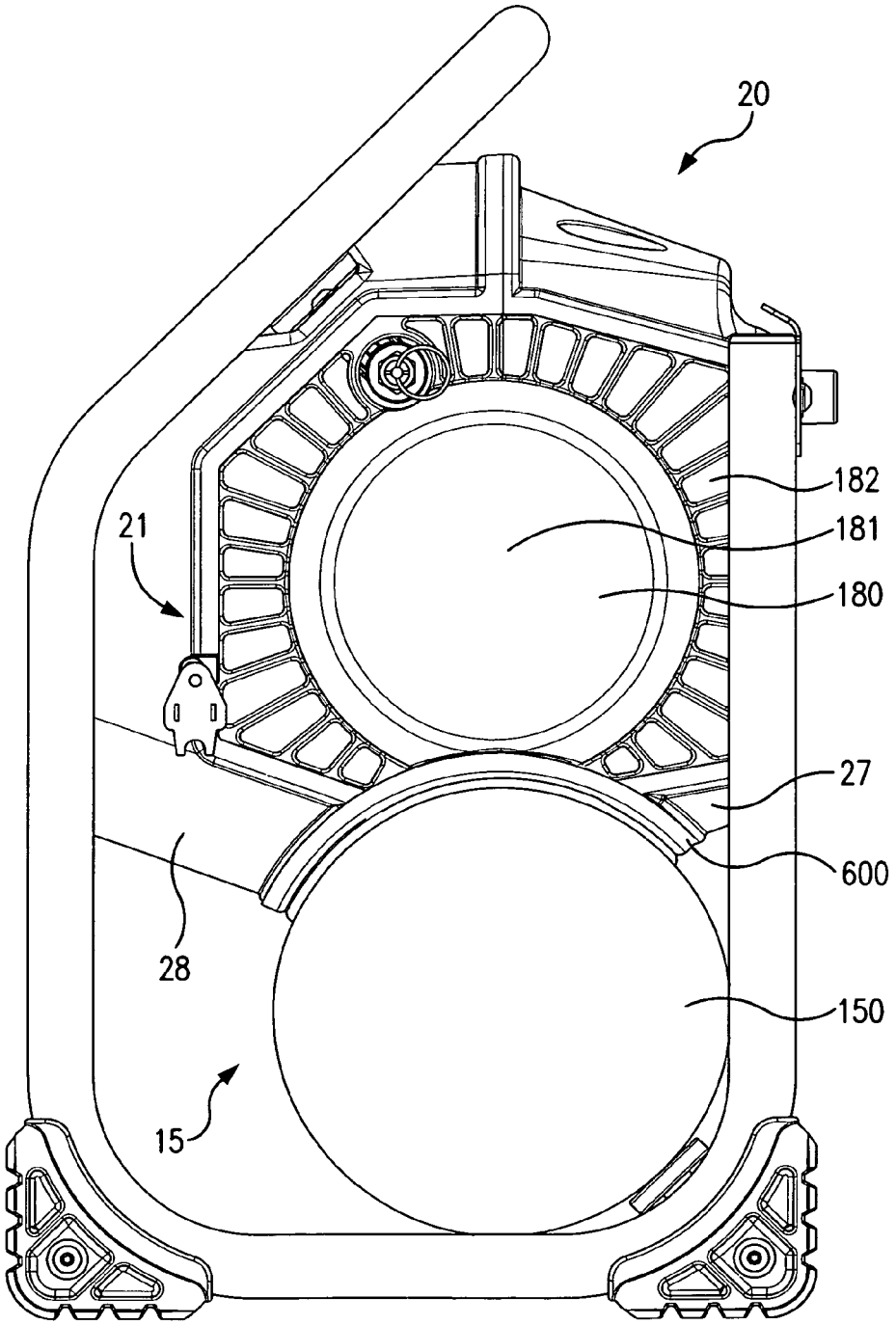
FIG. 5 is a fan-side perspective of the compressor assembly.

FIG. 5 illustrates tank seal 600 providing a seal between the housing 21 and compressed gas tank 150 viewed from fan-side 14. FIG. 5 is a fan-side perspective of the compressor assembly 20. FIG. 5 illustrates a fan-side housing 180 having a fan cover 181 with intake ports 182. FIG. 5 also shows a fan-side view of the compressed gas tank 150. Tank seal 600 is illustrated sealing the housing 21 to the compressed gas tank 150. Tank seal 600 can be a one piece member or can have a plurality of segments which form tank seal 600.

Figure 6:
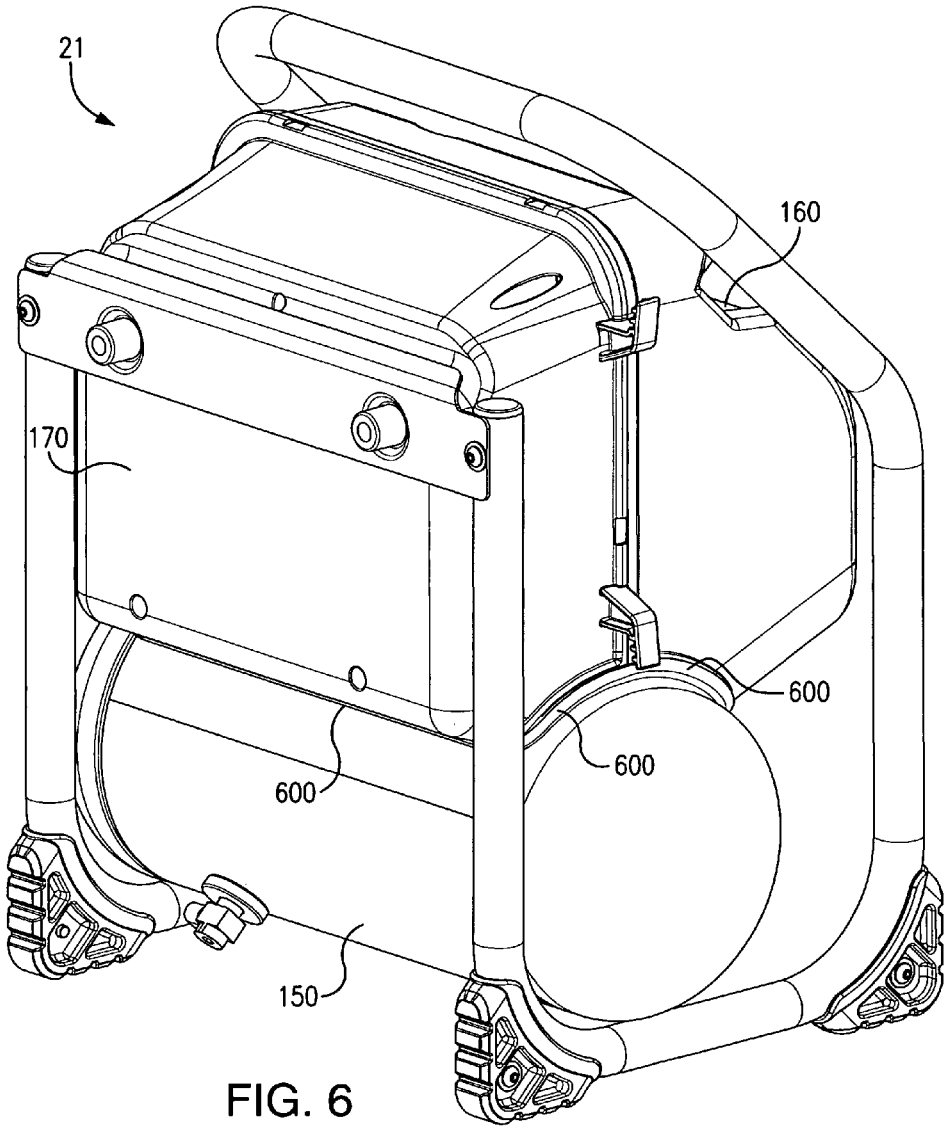
FIG. 6 is a rear perspective of the compressor assembly.

FIG. 6 is a rear-side perspective of the compressor assembly 20. FIG. 6 illustrates a tank seal 600 sealing the housing 21 to the compressed gas tank 150.

FIG. 7 is a rear view of internal components of the compressor assembly. In this sectional view, in which the rear housing 170 is not shown, the fan-side housing 180 has a fan cover 181 and intake ports 182. The fan-side housing 180 is configured to feed air to air ducting shroud 485. Air ducting shroud 485 has shroud inlet scoop 484 and conduit 253 which can feed a cooling gas, such as air, to the cylinder head 61 and pump cylinder 60.

Figure 8:
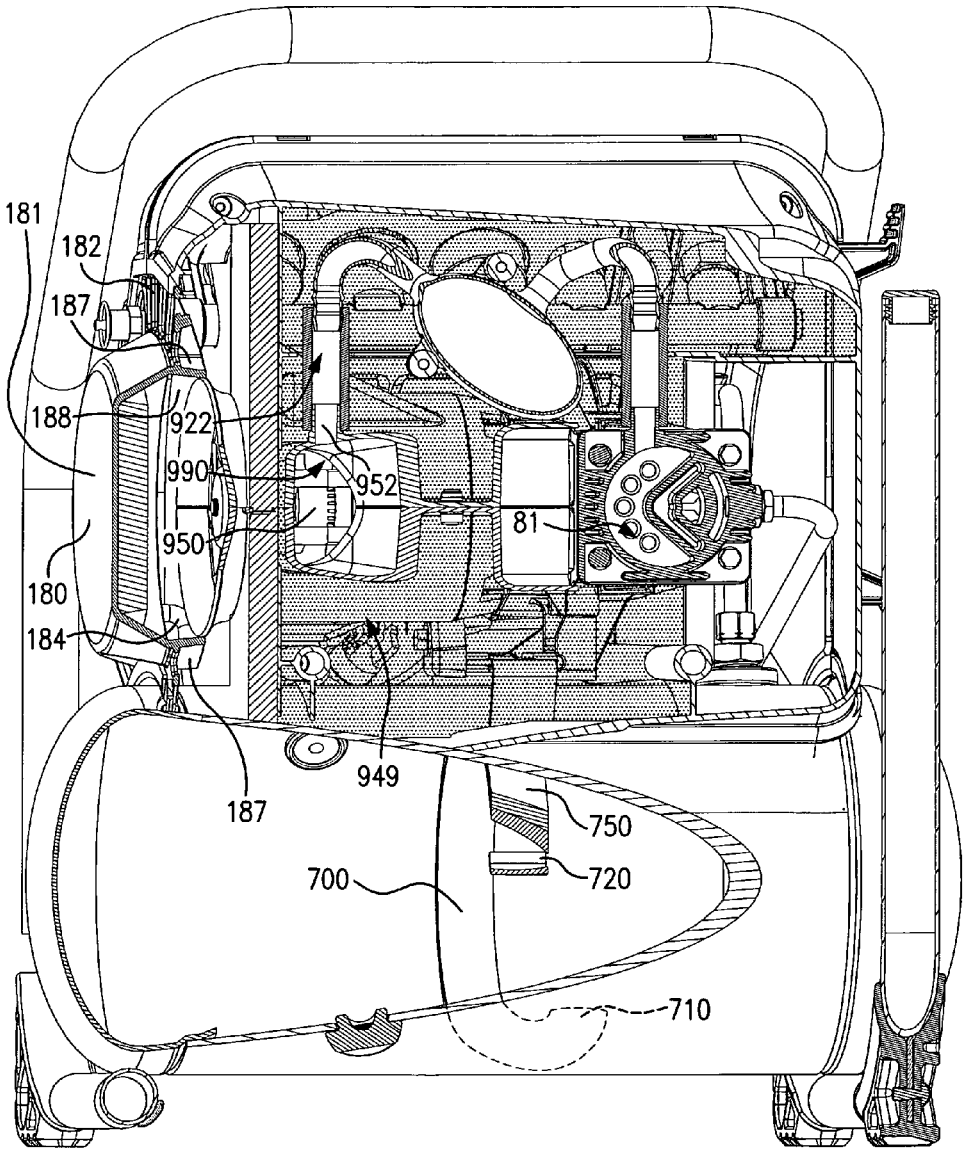
FIG. 8 is a rear sectional view of the compressor assembly.

FIG. 7 also provides a view of the feed air system 905. The feed air system 905 can feed a feed air 990 through a feed air port 952 for compression in the pump cylinder 60 of pump assembly 25. The feed air port 952 can optionally receive a clean air feed from an inertia filter 949 (FIG. 8). The clean air feed can pass through the feed air port 952 to flow through an air intake hose 953 and an intake muffler feed line 898 to the intake muffler 900. The clean air can flow from the intake muffler 900 through muffler outlet line 902 and cylinder head hose 903 to feed pump cylinder head 61. Noise can be generated by the compressor pump 299, such as when the piston forces air in and out of the valves of valve plate assembly 62. The intake side of the pump can provide a path for the noise to escape from the compressor which intake muffler 900 can serve to muffle.

The filter distance 1952 between an inlet centerline 1950 of the feed air port 952 and a scoop inlet 1954 of shroud inlet scoop 484 can vary widely and have a value in a range of from 0.5 in to 24 in, or even greater for larger compressor assemblies. The filter distance 1952 between inlet centerline 1950 and inlet cross-section of shroud inlet scoop 484 identified as scoop inlet 1954 can be e.g. 0.5 in, or 1.0 in, or 1.5 in, or 2.0 in, or 2.5 in, or 3.0 in, or 4.0 in, or 5.0 in or 6.0 in, or greater. In an embodiment, the filter distance 1952 between inlet centerline 1950 and inlet cross-section of shroud inlet scoop 484 identified as scoop inlet 1954 can be 1.859 in. In an embodiment, the inertia filter can have multiple inlet ports which can be located at different locations of the air ducting shroud 485. In an embodiment, the inertial filter is separate from the air ducting shroud and its feed is derived from one or more inlet ports.

FIG. 7 illustrates that compressed air can exit the cylinder head 61 via the compressed gas outlet port 782 and pass through the compressed gas outlet line 145 to enter the compressed gas tank 150. FIG. 7 also shows a rear-side view of manifold 303.

FIG. 8 is a rear sectional view of the compressor assembly 20. FIG. 8 illustrates the fan cover 181 having a plurality of intake ports 182. A portion of the fan cover 181 can be extended toward the shroud inlet scoop 484, e.g. the rim 187. In this embodiment, the fan cover 181 has a rim 187 which can eliminate a visible line of sight to the air inlet space 184 from outside of the housing 21. In an embodiment, the rim 187 can cover or overlap an air space 188. FIG. 8 illustrates an inertia filter 949 having an inertia filter chamber 950 and air intake path 922.

In an embodiment, the rim 187 can extend past the air inlet space 184 and overlaps at least a portion of the shroud inlet scoop 484. In an embodiment, the rim 187 does not extend past and does not overlap a portion of the shroud inlet scoop 484 and the air inlet space 184 can have a width between the rim 187 and a portion of the shroud inlet scoop 484 having a value of distance in a range of from 0.1 in to 2 in, e.g. 0.25 in, or 0.5 in. In an embodiment, the air ducting shroud 485 and/or the shroud inlet scoop 484 can be used to block line of sight to the fan 200 and the pump assembly 25 in conjunction with or instead of the rim 187.

The inertia filter 949 can provide advantages over the use of a filter media which can become plugged with dirt and/or particles and which can require replacement to prevent degrading of compressor performance. Additionally, filter media, even when it is new, creates a pressure drop and can reduce compressor performance.

Air must make a substantial change in direction from the flow of cooling air to become compressed gas feed air to enter and pass through the feed air port 952 to enter the air intake path 922 from the inertia filter chamber 950 of the inertia filter 949. Any dust and other particles dispersed in the flow of cooling air have sufficient inertia that they tend to continue moving with the cooling air rather than change direction and enter the air intake path 922.

FIG. 8 also shows a section of a dampening ring 700. The dampening ring 700 can optionally have a cushion member 750, as well as optionally a first hook 710 and a second hook 720.

FIG. 9 is a top view of the components of the pump assembly 25.

Pump assembly 25 can have a motor 33 which can drive the shaft 43 which causes a sprocket 49 to drive a drive belt 65 to rotate a pulley 66. The pulley 66 can be connected to and can drive the connecting rod 69 which has a piston 63 (FIG. 2) at an end. The piston 63 can compress a gas in the pump cylinder 60 pumping the compressed gas through the valve plate assembly 62 into the cylinder head 61 and then out through a compressed gas outlet port 782 through an outlet line 145 and into the compressed gas tank 150.

FIG. 9 also shows a pump 91. Herein, pump 91 collectively refers to a combination of parts including the cylinder head 61, the pump cylinder 60, the piston 63 and the connecting rod having the piston 63, as well as the components of these parts.

Figure 10:
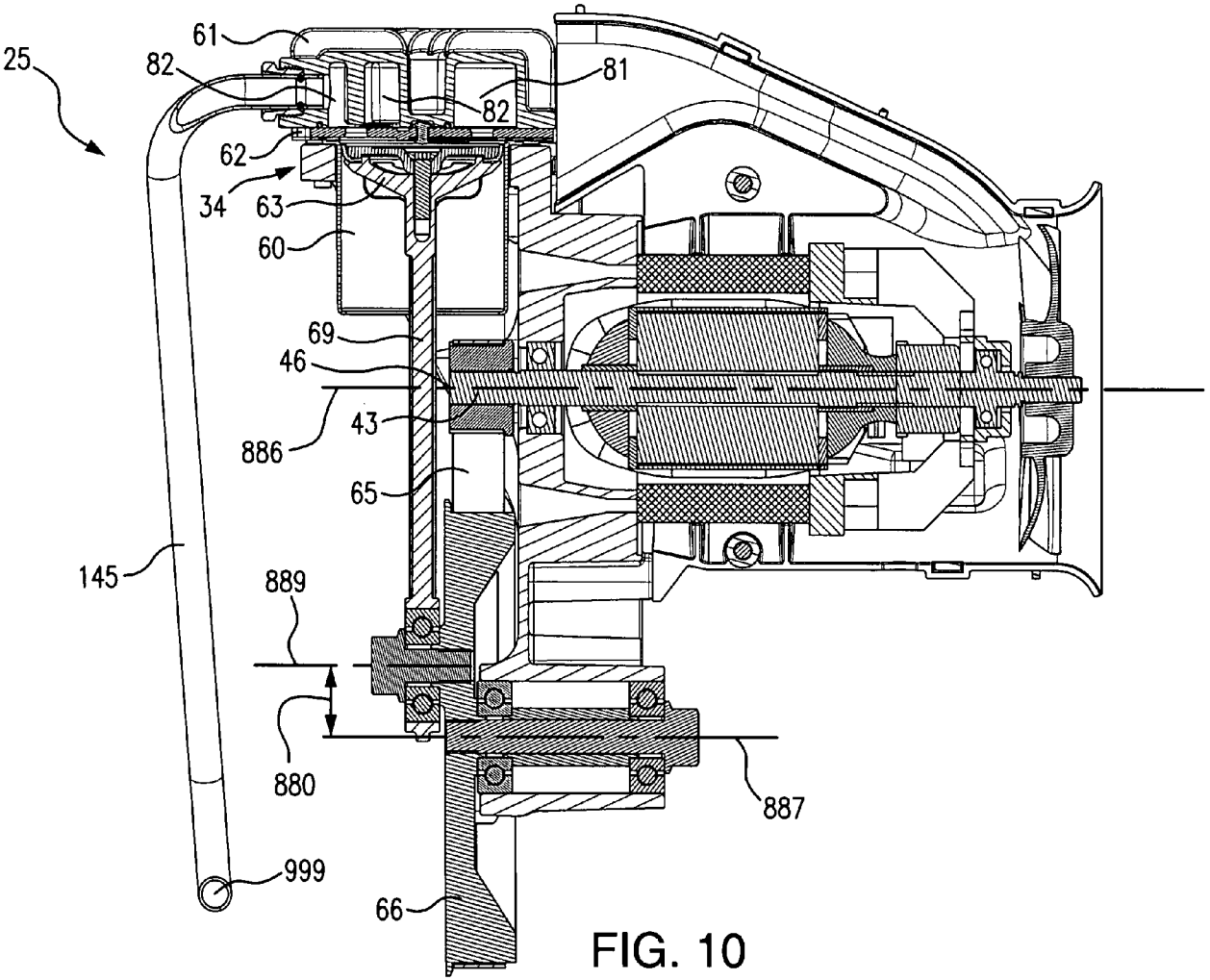
FIG. 10 is a top sectional view of the pump assembly.

FIG. 10 is a top sectional view of the pump assembly 25. FIG. 10 also shows a shaft centerline 886, as well as pulley centerline 887 and a rod bolt centerline 889 of a rod bolt 57. FIG. 10 illustrates an offset 880 which can be a dimension having a value in the range of 0.5 in to 12 in, or greater. In an embodiment, the stroke can be 1.592 in, from an offset 880 of 0.796 in. FIG. 10 also shows air inlet chamber 81.

Figure 11:
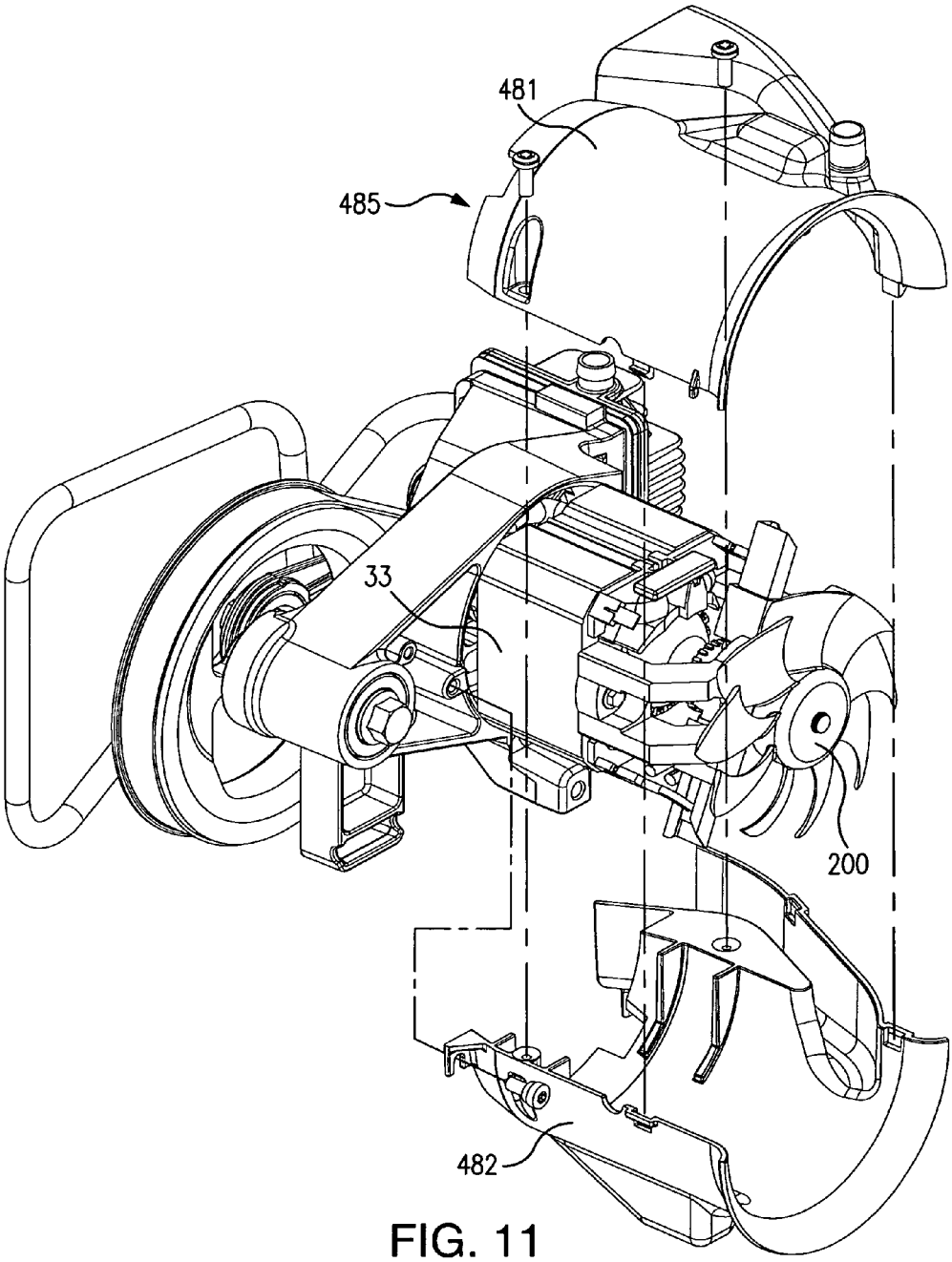
FIG. 11 is an exploded view of the air ducting shroud.

FIG. 11 illustrates an exploded view of the air ducting shroud 485. In an embodiment, the air ducting shroud 485 can have an upper ducting shroud 481 and a lower ducting shroud 482. In the example of FIG. 11, the upper ducting shroud 481 and the lower ducting shroud 482 can be fit together to shroud the fan 200 and the motor 33 and can create air ducts for cooling pump assembly 25 and/or the compressor assembly 20. In an embodiment, the air ducting shroud 485 can also be a motor cover for motor 33. The upper air ducting shroud 481 and the lower air ducting shroud 482 can be connected by a broad variety of means which can include snaps and/or screws.

Figure 12:
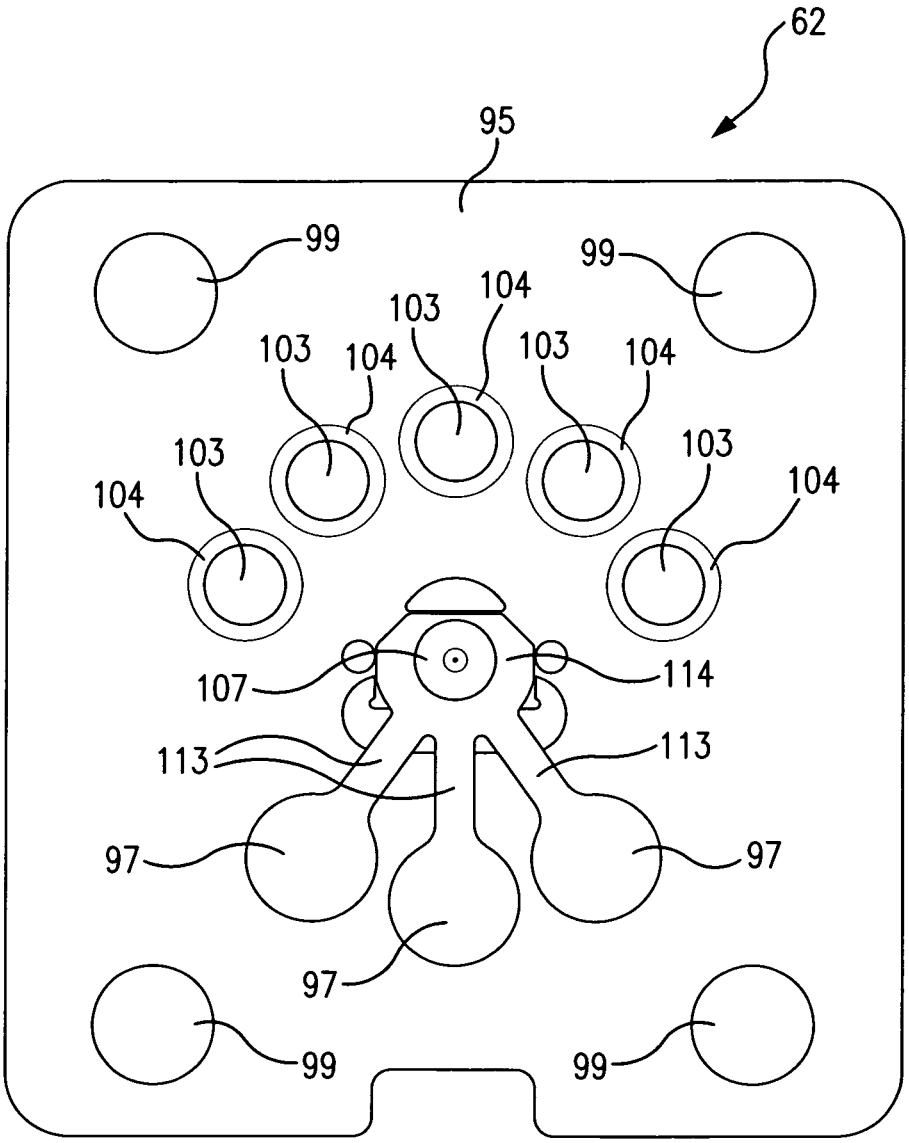
FIG. 12 is a rear view of a valve plate assembly.

FIG. 12 is a rear-side view of a valve plate assembly. A valve plate assembly 62 is shown in detail in FIGS. 12, 13 and 14.

The valve plate assembly 62 of the pump assembly 25 can include air intake and air exhaust valves. The valves can be of a reed, flapper, one-way or other type. A restrictor can be attached to the valve plate adjacent the intake valve. Deflection of the exhaust valve can be restricted by the shape of the cylinder head which can minimize valve impact vibrations and corresponding valve stress.

Figure 13:
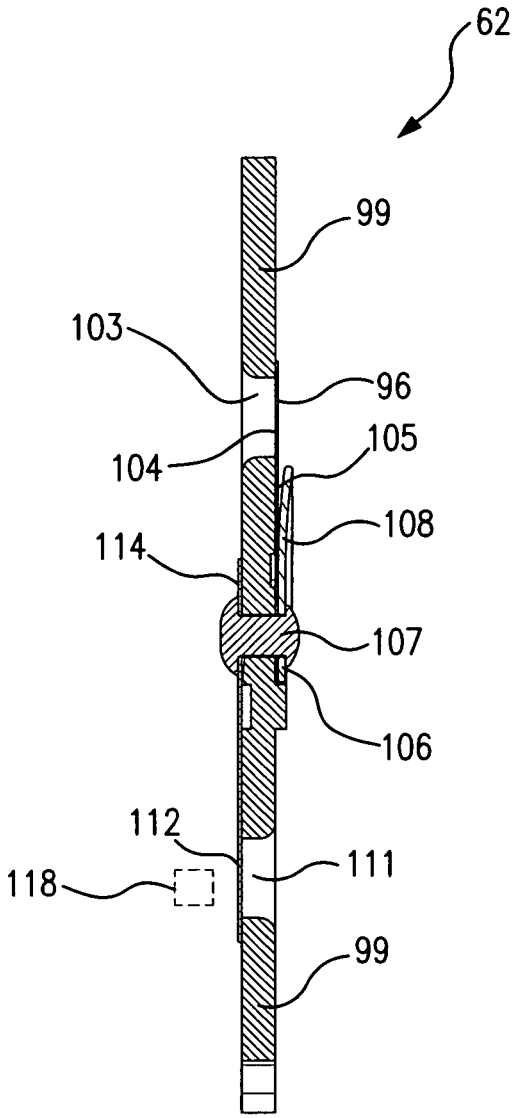
FIG. 13 is a cross-sectional view of the valve plate assembly.
Figure 14:
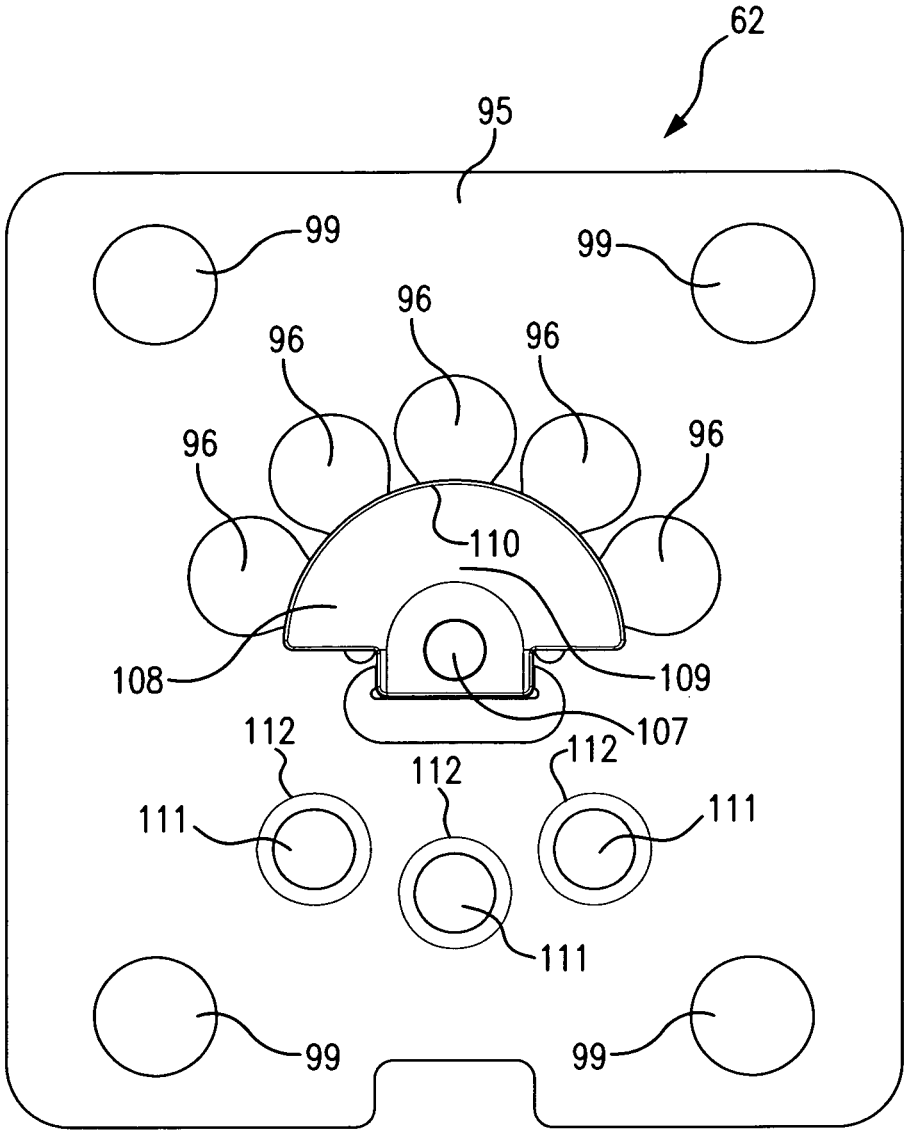
FIG. 14 is a front view of the valve plate assembly.

The valve plate assembly 62 has a plurality of intake ports 103 (five shown) which can be closed by the intake valves 96 (FIG. 14) which can extend from fingers 105 (FIG. 13). In an embodiment, the intake valves 96 can be of the reed or "flapper" type and are formed, for example, from a thin sheet of resilient stainless steel. Radial fingers 113 (FIG. 12) can radiate from a valve finger hub 114 to connect the plurality of valve members 104 of intake valves 96 and to function as return springs. A rivet 107 secures the hub 106 (e.g. FIG. 13) to the center of the valve plate 95. An intake valve restrictor 108 can be clamped between the rivet 107 and the hub 106. The surface 109 terminates at an edge 110 (FIGS. 13 and 14). When air is drawn into the pump cylinder 60 during an intake stroke of the piston 63, the radial fingers 113 can bend and the plurality of valve members 104 separate from the valve plate assembly 62 to allow air to flow through the intake ports 103.

FIG. 13 is a cross-sectional view of the valve plate assembly and FIG. 14 is a front-side view of the valve plate assembly. The valve plate assembly 62 includes a valve plate 95 which can be generally flat and which can mount a plurality of intake valves 96 (FIG. 14) and a plurality of outlet valves 97 (FIG. 12). In an embodiment, the valve plate assembly 62 (FIGS. 10 and 12) can be clamped to a bracket by screws which can pass through the cylinder head 61 (e.g. FIG. 2), the gasket and a plurality of through holes 99 in the valve plate assembly 62 and engage a bracket. A valve member 112 of the outlet valve 97 can cover an exhaust port 111. A cylinder flange and a gas tight seal can be used in closing the cylinder head assembly. In an embodiment, a flange and seal can be on a cylinder side (herein front-side) of a valve plate assembly 62 and a gasket can be between the valve plate assembly 62 and the cylinder head 61.

FIG. 14 illustrates the front side of the valve plate assembly 62 which can have a plurality of exhaust ports 111 (three shown) which are normally closed by the outlet valves 97. A plurality of a separate circular valve member 112 can be connected through radial fingers 113 (FIG. 12) which can be made of a resilient material to a valve finger hub 114. The valve finger hub 114 can be secured to the rear side of the valve plate assembly 62 by the rivet 107. Optionally, the cylinder head 61 can have a head rib 118 (FIG. 13) which can project over and can be spaced a distance from the valve members 112 to restrict movement of the exhaust valve members 112 and to lessen and control valve impact vibrations and corresponding valve stress.

Figure 15A:
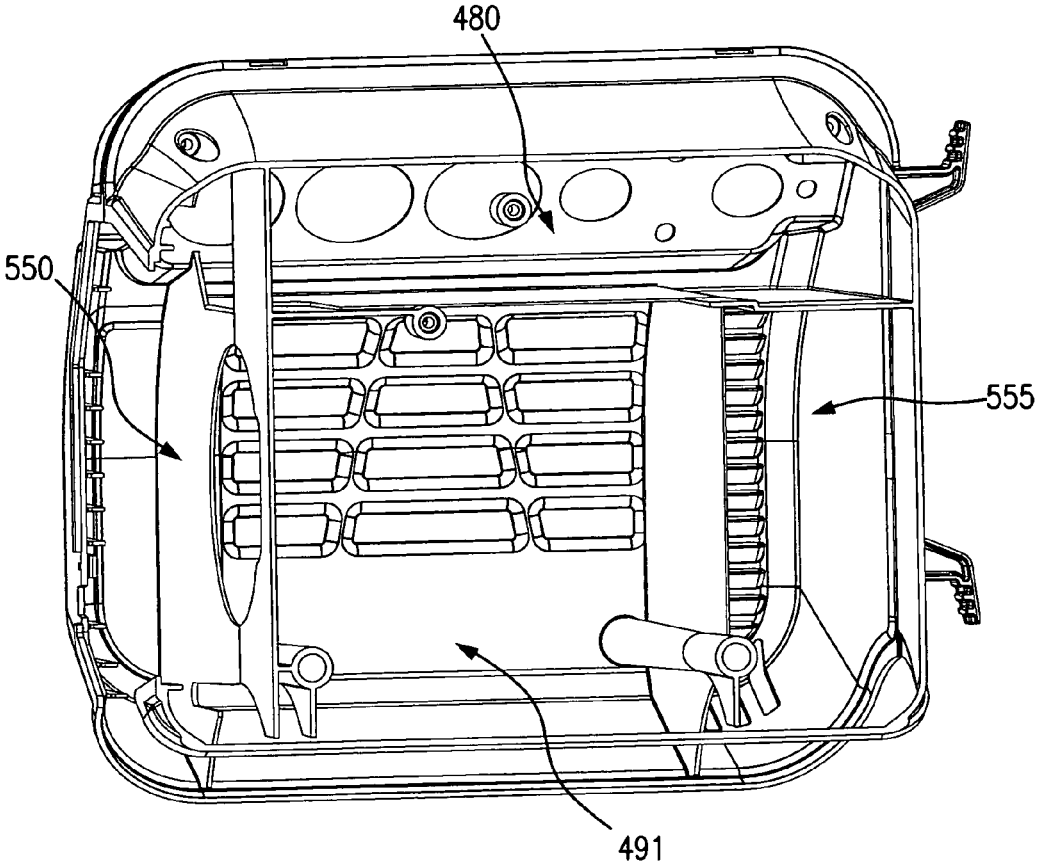
FIG. 15A is a perspective view of sound control chambers of the compressor assembly.

FIG. 15A is a perspective view of a plurality of sound control chambers of an embodiment of the compressor assembly 20. FIG. 15A illustrates an embodiment having four (4) sound control chambers. The number of sound control chambers can vary widely in a range of from one to a large number, e.g. 25, or greater. In a non-limiting example, in an embodiment, a compressor assembly 20 can have a fan sound control chamber 550 (also herein as "fan chamber 550"), a pump sound control chamber 491 (also herein as "pump chamber 491"), an exhaust sound control chamber 555 (also herein as "exhaust chamber 555"), and an upper sound control chamber 480 (also herein as "upper chamber 480").

Figure 15B:
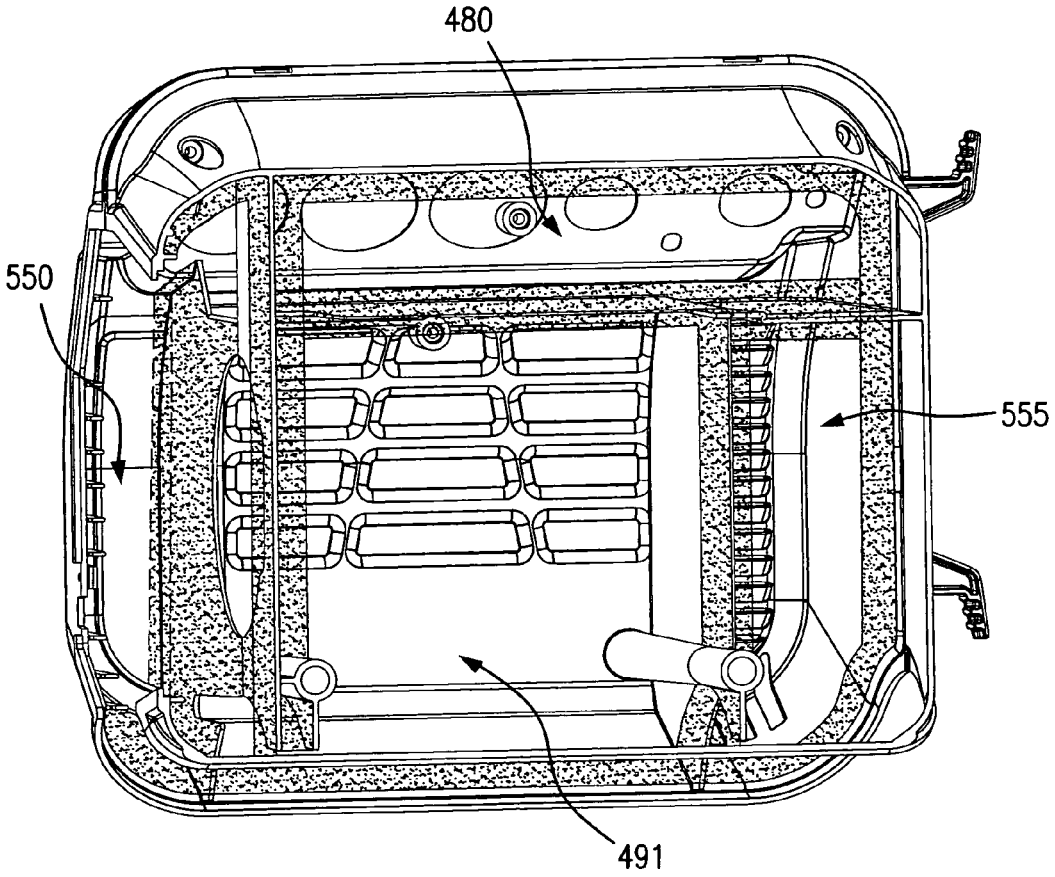
FIG. 15B is a perspective view of sound control chambers having optional sound absorbers.

FIG. 15B is a perspective view of sound control chambers having optional sound absorbers. The optional sound absorbers can be used to line the inner surface of housing 21, as well as both sides of partitions which are within the housing 21 of the compressor assembly 20.

Figure 16A:
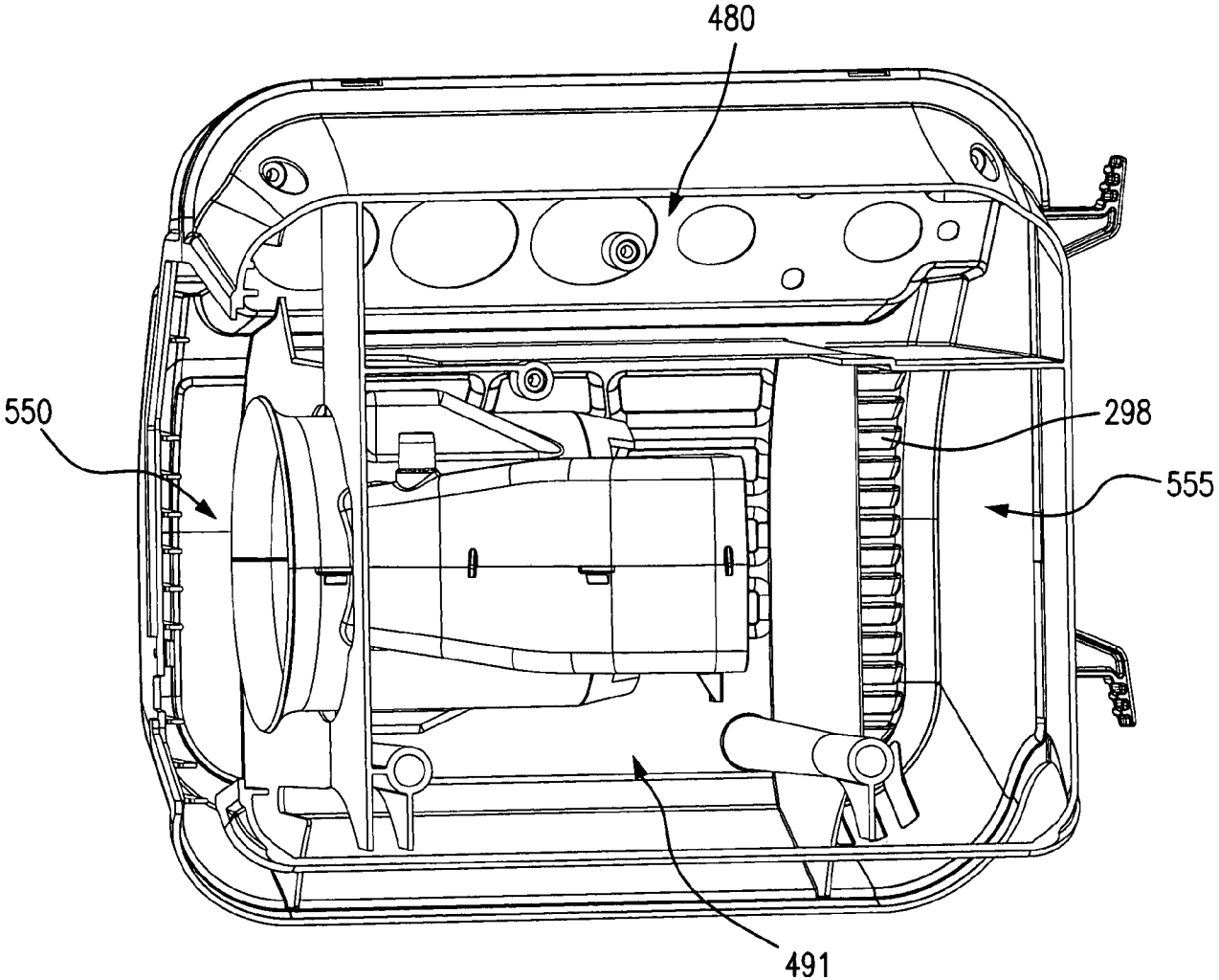
FIG. 16A is a perspective view of sound control chambers with an air ducting shroud.

FIG. 16A is a perspective view of sound control chambers with an air ducting shroud 485. FIG. 16A illustrates the placement of air ducting shroud 485 in coordination with, for example, the fan chamber 550, the pump sound control chamber 491, the exhaust sound control chamber 555, and the upper sound control chamber 480.

Figure 16B:
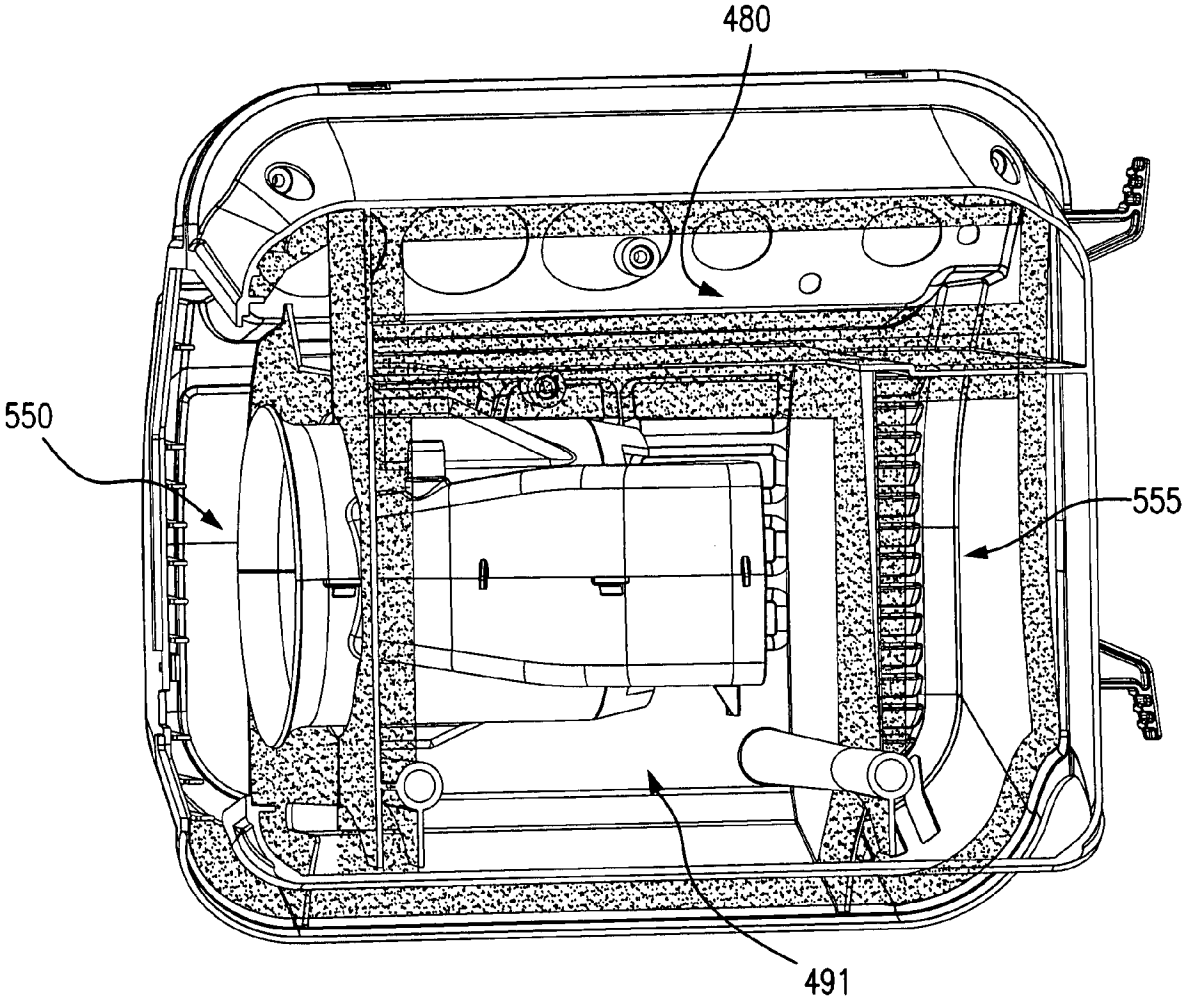
FIG. 16B is a perspective view of sound control chambers having optional sound absorbers.

FIG. 16B is a perspective view of sound control chambers having optional sound absorbers. The optional sound absorbers can be used to line the inner surface of housing 21, as well as both sides of partitions which are within the housing 21 of compressor assembly 20.

FIG. 17 is a first table of embodiments of compressor assembly range of performance characteristics. The compressor assembly 20 can have values of performance characteristics as recited in FIG. 17 which are within the ranges set forth in FIG. 17.

FIG. 18 is a second table of embodiments of ranges of performance characteristics for the compressor assembly 20. The compressor assembly 20 can have values of performance characteristics as recited in FIG. 18 which are within the ranges set forth in FIG. 18.

The compressor assembly 20 achieves efficient heat transfer. The heat transfer rate can have a value in a range of from 25 BTU/min to 1000 BTU/min. The heat transfer rate can have a value in a range of from 90 BTU/min to 500 BTU/min. In an embodiment, the compressor assembly 20 can exhibit a heat transfer rate of 200 BTU/min. The heat transfer rate can have a value in a range of from 50 BTU/min to 150 BTU/min. In an embodiment, the compressor assembly 20 can exhibit a heat transfer rate of 135 BTU/min. In an embodiment, the compressor assembly 20 exhibited a heat transfer rate of 84.1 BTU/min.

The heat transfer rate of a compressor assembly 20 can have a value in a range of 60 BTU/min to 110 BTU/min. In an embodiment of the compressor assembly 20, the heat transfer rate can have a value in a range of 66.2 BTU/min to 110 BTU/min; or 60 BTU/min to 200 BTU/min.

The compressor assembly 20 can have noise emissions reduced by, for example, slower fan and/or slower motor speeds, use of a check valve muffler, use of tank vibration dampeners, use of tank sound dampeners, use of a tank dampening ring, use of tank vibration absorbers to dampen noise to and/or from the tank walls which can reduce noise. In an embodiment, a two stage intake muffler can be used on the pump. A housing having reduced or minimized openings can reduce noise from the compressor assembly. As disclosed herein, the elimination of line of sight to the fan and other components as attempted to be viewed from outside of the compressor assembly 20 can reduce noise generated by the compressor assembly. Additionally, routing cooling air through ducts, using foam lined paths and/or routing cooling air through tortuous paths can reduce noise generation by the compressor assembly 20.

Additionally, noise can be reduced from the compressor assembly 20 and its sound level lowered by one or more of the following, employing slower motor speeds, using a check valve muffler and/or using a material to provide noise dampening of the housing 21 and its partitions and/or the compressed air tank 150 heads and shell. Other noise dampening features can include one or more of the following and be used with or apart from those listed above, using a two-stage intake muffler in the feed to a feed air port 952, elimination of line of sight to the fan and/or other noise generating parts of the compressor assembly 20, a quiet fan design and/or routing cooling air routed through a tortuous path which can optionally be lined with a sound absorbing material, such as a foam. Optionally, fan 200 can be a fan which is separate from the shaft 43 and can be driven by a power source which is not shaft 43.

In an example, an embodiment of compressor assembly 20 achieved a decibel reduction of 7.5 dBA. In this example, noise output when compared to a pancake compressor assembly was reduced from about 78.5 dBA to about 71 dBA.

EXAMPLE 1

FIG. 19 is a first table of example performance characteristics for an example embodiment. FIG. 19 contains combinations of performance characteristics exhibited by an embodiment of compressor assembly 20.

EXAMPLE 2

FIG. 20 is a second table of example performance characteristics for an example embodiment. FIG. 20 contains combinations of further performance characteristics exhibited by an embodiment of compressor assembly 20.

EXAMPLE 3

FIG. 21 is a table containing a third example of performance characteristics of an example compressor assembly 20. In the Example of FIG. 21, a compressor assembly 20 having an air ducting shroud 485, a dampening ring 700, an intake muffler 900, four sound control chambers, a fan cover, four foam sound absorbers and a tank seal 600 exhibited the performance values set forth in FIG. 21.

Figure 22:
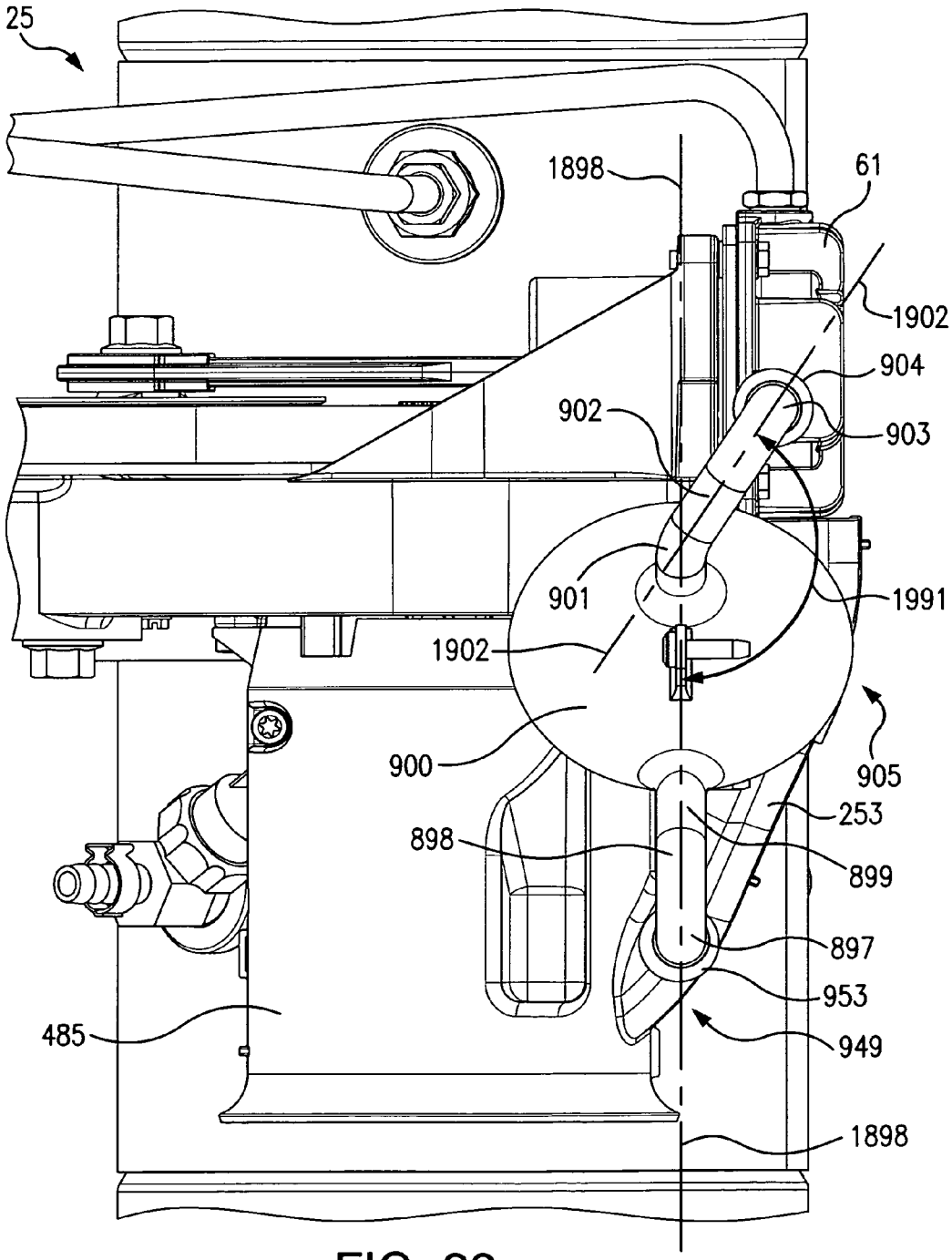
FIG. 22 is a top view of a feed air system having a muffler.
Figure 23:
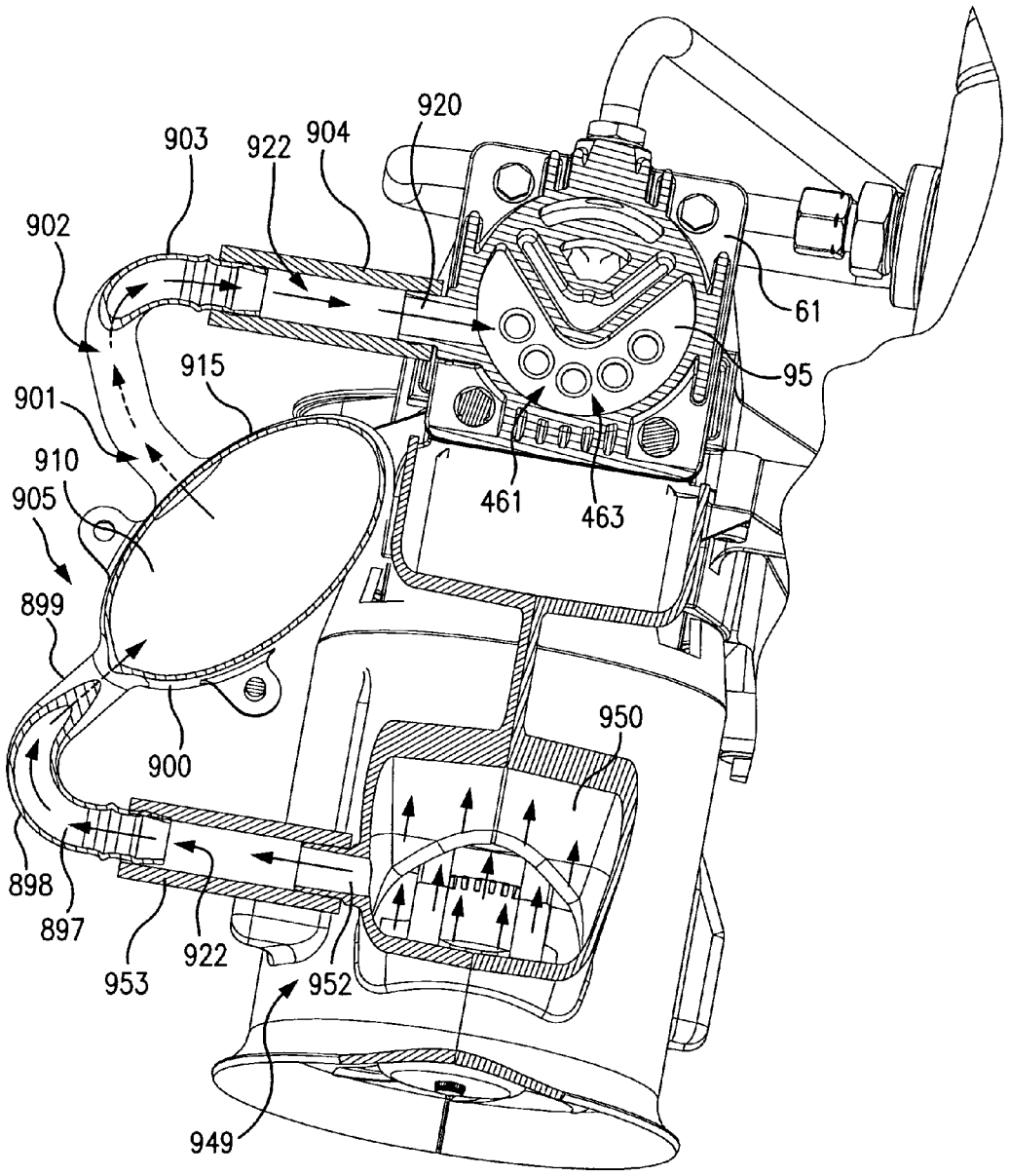
FIG. 23 is a sectional view of the inertia filter and the muffler.

FIGS. 22 and 23 illustrate a top view of a feed air system 905 having an intake muffler 900 (also herein as "compressor intake muffler 900" or "muffler 900").

The feed air system 905 can feed air to be compressed along the feed air path 922 (FIG. 23) from a feed air port 952 to the cylinder head 61. In an embodiment, air can be fed from an optional inertia filter 949 which can be present in the air ducting shroud 485 (FIG. 22). In an embodiment, the intake muffler 900 can be in the feed path to the cylinder head 61. In an embodiment, the air ducting shroud 485 is optional. In an embodiment, a muffler 900 can be used without an air ducting shroud 485. In an embodiment, a muffler 900 can be used without an inertia filter. In an embodiment, a muffler 900 can be used with an inertia filter and without an air ducting shroud 485. In an embodiment, an intake muffler 900 can be used in conjunction with a mechanical air filter, and/or air filter material.

FIG. 23 further is a sectional view of the inertia filter 949 and the intake muffler 900. The feed air port 952 can provide feed to an air intake hose 953. The air intake hose 953 can connect with an intake muffler feed line 898 which can have a muffler feed line inlet portion 897 and a muffler feed portion 899. The muffler feed portion 899 can feed the intake muffler 900. The intake muffler 900 can have a muffler outlet line 902. The muffler outlet line 902 can have a muffler outlet portion 901 and a hose feed portion 903.

In the example embodiment illustrated in FIG. 22, the muffler outlet line 902 can have a head feed centerline 1902 which can be at an angle 1991 of 146 degrees as measured from the intake muffler intake centerline 1898 of the intake muffler feed line 898 in a top view as depicted in FIG. 22.

FIG. 23 further illustrates the inertia filter 949 which can have an inertia filter chamber 950 and the feed air port 952. The inertia filter 949 can be a maintenance-free intake filter. The combination of the intake muffler 900 and the inertia filter 949 can reduce the sound level of an air compressor and provide a maintenance-free intake filter. The inertia filter feed air port 952 can optionally have a small diameter; in non-limiting example having a value in the range of 0.05 to 2.0 in. In an embodiment, the internal diameter (also herein as "ID") of the feed air port 952 exiting the inertia 949 filter can have a value in a range of from 0.1 in to 6 in. In an embodiment, the ID of the feed air port 952 exiting inertia filter can be 0.400 in or smaller. In an embodiment, the ID of the feed air port 952 exiting inertia filter can be, e.g. 0.75 in, or 0.50 in, or 0.4 in, or 0.3 in, or 0.20 in, or smaller.

The feed air port 952 can provide feed to the intake muffler 900. The inertia filter 949 can prevent particulates, e.g. dirt particles, from entering the cylinder head 61 and/or compressor and/or compressor system. In an embodiment, the inertia filter 949 can be used in conjunction with a filter and/or filter media. In an embodiment, the inertia filter 949 can prevent degrading of the compressor performance because it can prevent the accumulation of particulates and dirt and can protect the compressor and its components, e.g. the pump cylinder 60 and the piston 63 from being exposed to damaging particles. Additionally, the inertia filter 949 can have a very low pressure drop, which can be less than 1 psi, e.g. 0.05 psi, or less.

In an embodiment, the inertia filter 949 can block and/or attenuate a portion of the noise produced by the pump assembly 25, e.g. from the cylinder head 61. In an embodiment, the compressor assembly 20 can have both an inertia filter 949 and an intake muffler 900 to achieve reduction of the noise level of the compressor assembly 20.

FIG. 23 illustrates the feed air system 905 having a feed air path 922 which is fed from inertia filter 949. Compressed air feed enters the feed air path 922 through the feed air port 952, then can pass through the intake muffler feed line 898, then through the intake muffler 900 then can pass through the muffler outlet line 902, then can pass through the cylinder head feed hose 904 and then through a cylinder head intake port 920.

In an embodiment, the ID of the cylinder head intake port 920 can have a value in a range of from 0.15 in to 3.0 in. In an embodiment, the ID of the cylinder head intake port 920 can have a value in a range of from 0.25 in to 1.75 in. In an embodiment, the ID of the cylinder head intake port 920 can have a value in a range of from 0.25 in to 0.50 in. In an embodiment, the ID of the cylinder head intake port 920 can be 0.380, or smaller.

In an embodiment, the intake muffler 900 can include a large chamber which can be a muffler chamber 910 with two tubes extending therefrom, e.g. the intake muffler feed line 898 and the muffler outlet line 902. The muffler chamber 910 can optionally be large, or larger, in diameter as compared to the diameter of the intake muffler feed line 898 or the diameter of the muffler outlet line 902. Optionally, the two tubes can be smaller in diameter as compared to the muffler chamber 910. In an embodiment, the volume of muffler chamber 910 can have a volume with a value in a range of from 3.14 in^3 to 150 in^3, or greater. In an embodiment, the volume of muffler chamber 910 can be 10.85 in^3. In an embodiment, the volume of muffler chamber 910 can be 30 in^3. In a non-limiting example, these two small tubes can be an intake muffler feed line 898 and a muffler outlet line 902. In an embodiment, the volume of muffler chamber 910, the volume of the intake muffler feed line 898, and the volume of the muffler outlet line 902 can have a total volume of 11.75 in^3.

The feed air port 952 can be plumbed so that it is located in and/or fed from the path of the high velocity cooling air for the compressor. It can be assembled perpendicular to this high velocity flow to provide the inertia filter 949. The muffler outlet line 902 can be a tube which connects to the small intake opening in the head.

In an embodiment, the feed air port 952 can be plumbed so that it is located in and/or fed from the path of the high velocity cooling air for the compressor. It can be assembled perpendicular to this high velocity flow to provide the inertia filter 949.

The cylinder head 61 can include a head cavity 461 which encloses the intake valve area 463. The cylinder head 61 can have a cylinder head intake port 920. In an embodiment, the cylinder head intake port can be larger than the diameter of at least one element of the feed air path 922 to the cylinder head intake port 920. In an embodiment, elements of the feed air path 922 can include the feed air port 952, the intake muffler feed line 898, the intake muffler 900, the muffler outlet line 902 and cylinder head feed hose 904. For example, the feed air port 952 can have an inner diameter which is smaller than an inner diameter of the cylinder head intake port 920. In an embodiment, by having a diameter along the feed air path 922, which can be smaller than the diameter of the cylinder head intake port 920, the smaller diameter opening can dampen or attenuate noise generated inside of the pump and which can escape through the cylinder head intake port 920.

In a non-limiting example, unwanted noise can escape through a plurality of an intake port 103 of the valve plate assembly 62 of the cylinder head 61. The intake muffler 900 can dampen or muffle noise which can escape from, for example, the cylinder head 61.

In an embodiment, the sound waves escaping through the small opening in the cylinder head 61 can travel through a first tube, such as the muffler outlet line 902, and into the large chamber, such as the muffler chamber 910. The waves can expand and move around in the muffler chamber 910 and can be attenuated before some of them travel out from a second tube, e.g. the intake muffler feed line 898, and then out of compressor assembly 20, and optionally to the atmosphere. The muffler can reduce the noise emitted from the intake muffler feed line 898 and/or the cylinder head 61. In an embodiment, intake muffler 900 can have a muffler chamber 910 can have a rounded and/or curved shape such as oval or spherical and be such that the shape eliminates flat walls which could be excited and generate additional sound waves and/or noise. In an embodiment, the intake muffler 900 and/or the muffler chamber 910 can be produced by a blow molding process. In an embodiment, the intake muffler 900 and/or the muffler chamber 910, as well as the first tube, such as the muffler outlet line 902, and the second tube, such as the intake muffler feed line 898, to the atmosphere can be produced as one part by a blow molding process.

In an embodiment, the intake muffler 900 and/or the muffler chamber 910, as well as the first tube, such as the muffler outlet line 902, and the second tube, such as the intake muffler feed line 898, can be produced by the blow molding process such that all or part of the blow-molded piece can have an average wall thickness of 0.05 in. The intake muffler 900 and/or the muffler chamber 910 can be blow-molded as separate parts which can be joined together. A multi-piece production process can simplify fabrication and achieve consistent wall thicknesses, which can range in thickness from 0.02 in to 0.25 in, such as 0.025 in, or 0.03 in, or 0.05 in, or 0.075 in, or 0.125 in.

In embodiments, the intake muffler 900 and/or the muffler chamber 910 can be manufactured as one, two, three, four, or more pieces. The piece and/or pieces can be manufactured by one or more processes, such as, but not limited to, blow molding, injection molding, thermoset molding, milling or other process. The materials of production can be any of, but not limited to, plastic, polymer, fiberglass, composites, ceramics, metal, glass, woven materials, woven mesh, woven wires or other material. In an embodiment, the intake muffler 900 can have the first tube, such as the muffler outlet line 902, and the second tube, such as the intake muffler feed line 898, which have inner diameters which are the same or different.

In an embodiment, the inner diameter of the intake muffler feed line 898 and/or the muffler outlet line 902 can be the same as the inner diameter of the intake port 920, or less than the inner diameter of the intake port 920. In an embodiment the inner diameter of the intake muffler feed line 898 and/or the muffler outlet line 902 can be in a range of 50% to 100%, such as 50%, or 75%, or 80%, or 90%, or 95%, or 97% of the inner diameter of the intake port 920.

In an embodiment, the inner diameter of the intake muffler feed line 898 and/or the muffler outlet line 902 to the inner diameter of the intake muffler 900 can be in a range of 5% to 75% of an inner dimension of the intake muffler 900, such as 10%, or 25%, or 33%, or 40%, or 45%, or 50%, or 55%, or 60%, or 75%. In an embodiment in which the intake muffler 900 has an inner diameter, the inner diameter of the intake muffler feed line 898 and/or the muffler outlet line 902 to the inner diameter of the intake muffler 900 can be in a range of 40% to 50%, of the inner diameter of the intake muffler 900, such as 42%, or 42.5%, or 45%, or 47.5%, or 48%. In an embodiment, the inner diameter of the intake muffler feed line 898 and/or the muffler outlet line 902 can be equal to or greater than 0.25 in. In an embodiment the inner diameter of the intake muffler feed line 898 and/or the muffler outlet line 902 can be less than 0.5 in. In an embodiment, the inner diameter of the intake muffler feed line 898 and/or the muffler outlet line 902 can be in a range of from 0.2 in to 3 in, such as 0.25 in, or 0.5 in, or 0.75 in, or 1.0 in, or 1.25 in, 1.3 in, or 1.4 in, or 1.5 in, or 1.6 in, or 1.7 in, or 1.75 in, or 2.0 in.

In other embodiments, the inner cross sectional area of the intake muffler feed line 898 and/or the muffler outlet line 902 can be in a range of from 5% to 80% of an inner cross sectional area of the muffler, such as 15%, or 20%, or 25%, or 30%, or 35%, or 40%, or 50%.

The intake muffler 900 can lower the noise level (sound level) emitted from the pump assembly 25, cylinder head 61 and/or compressor assembly 20.

In an embodiment, the feed air 990 fed to the feed air system 905 undergoes an abrupt change in flow direction from the direction taken by the air which becomes cooling air as the feed air 990 exits the air ducting shroud 485 and enters feed air port 952. Particles contained in the portion of cooling air stream 2000 which becomes feed air 990 by entering feed air port 952 pass by the feed air port 952 as a consequence of the inertia of the particles.

Figure 24:
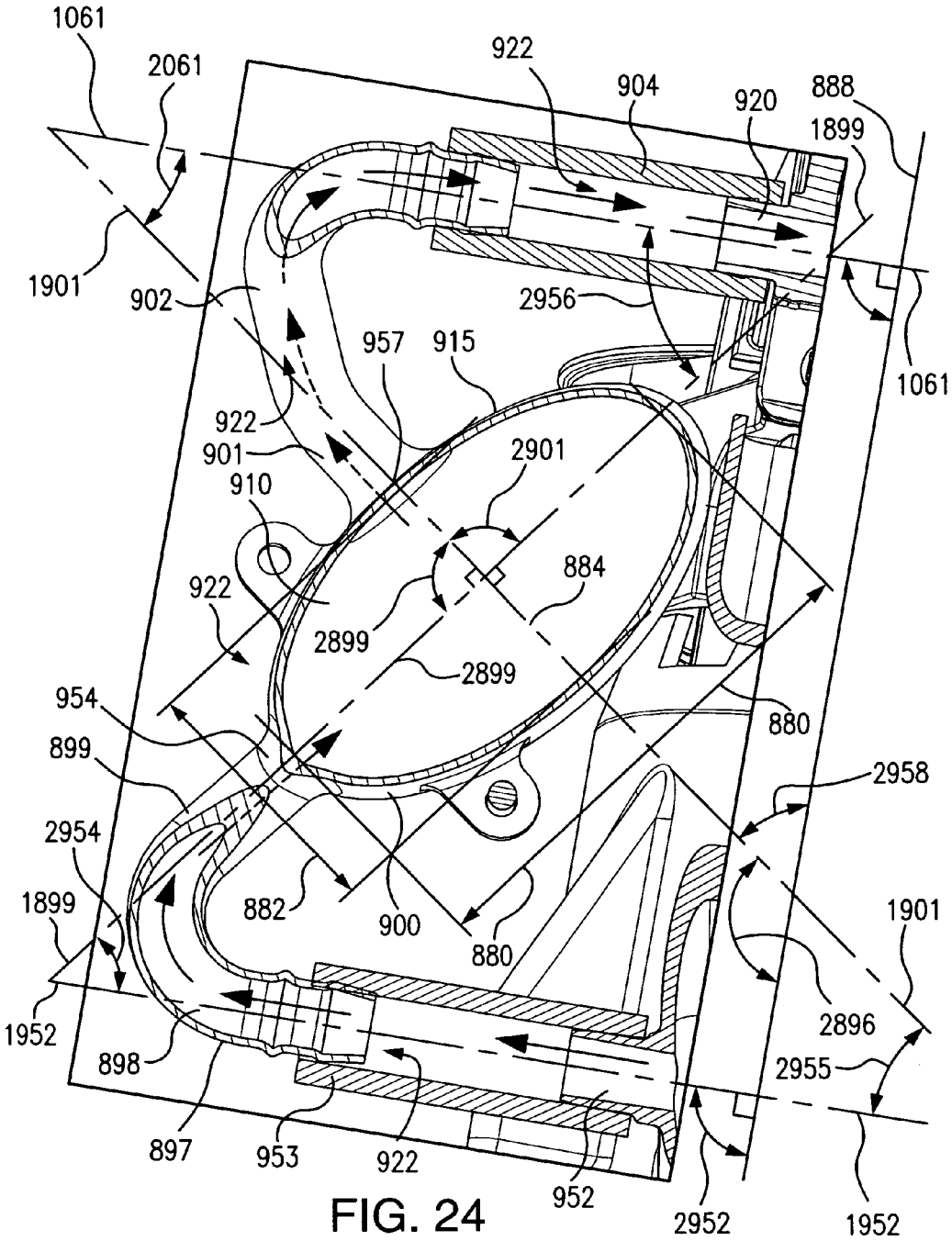
FIG. 24 is a sectional view of the muffler.

FIG. 24 is a sectional view of the muffler. FIG. 24 illustrates a muffler 900 which can have a major internal chord 880 which can have a distance which can optionally be measured along a muffler major axis 2899. The major internal chord 880 optionally can be coaxial with the muffler feed centerline 1899. In an embodiment, the major internal chord 880 can have an ID in a range of from 1.0 in to 16.0 in. In an embodiment, the major internal chord 880 can be an ID with a distance of 3.40 in. In an embodiment, the OD along the major axis length collinear with muffler feed centerline 1899 of muffler can be 3.500 in.

The muffler 900 can also have a minor internal chord 882 which can optionally be measured along a muffler minor axis 884 can be an ID with a distance of 1.800 in. In an embodiment, the minor internal chord 882 can have an ID in a range of from 1.0 in to 16.0 in. In an embodiment, the OD of minor axis width of muffler can be 1.900 in.

In an embodiment, the ratio of the internal chord 880 to the minor internal chord 882 can have a value in a range of from 1.0 to 12.0, or greater. In an embodiment, the ratio of the major internal chord 880 to the minor internal chord 882 can be greater than 1.2. In an embodiment, the ratio of the major internal chord 880 to the minor internal chord 882 can be greater than 1.5. In an embodiment, the ratio of the major internal chord 880 to the minor internal chord 882 can be greater than 4.0. In an embodiment, the ratio of the major internal chord 880 to the minor internal chord 882 can be 1.88.

Figure 23A:
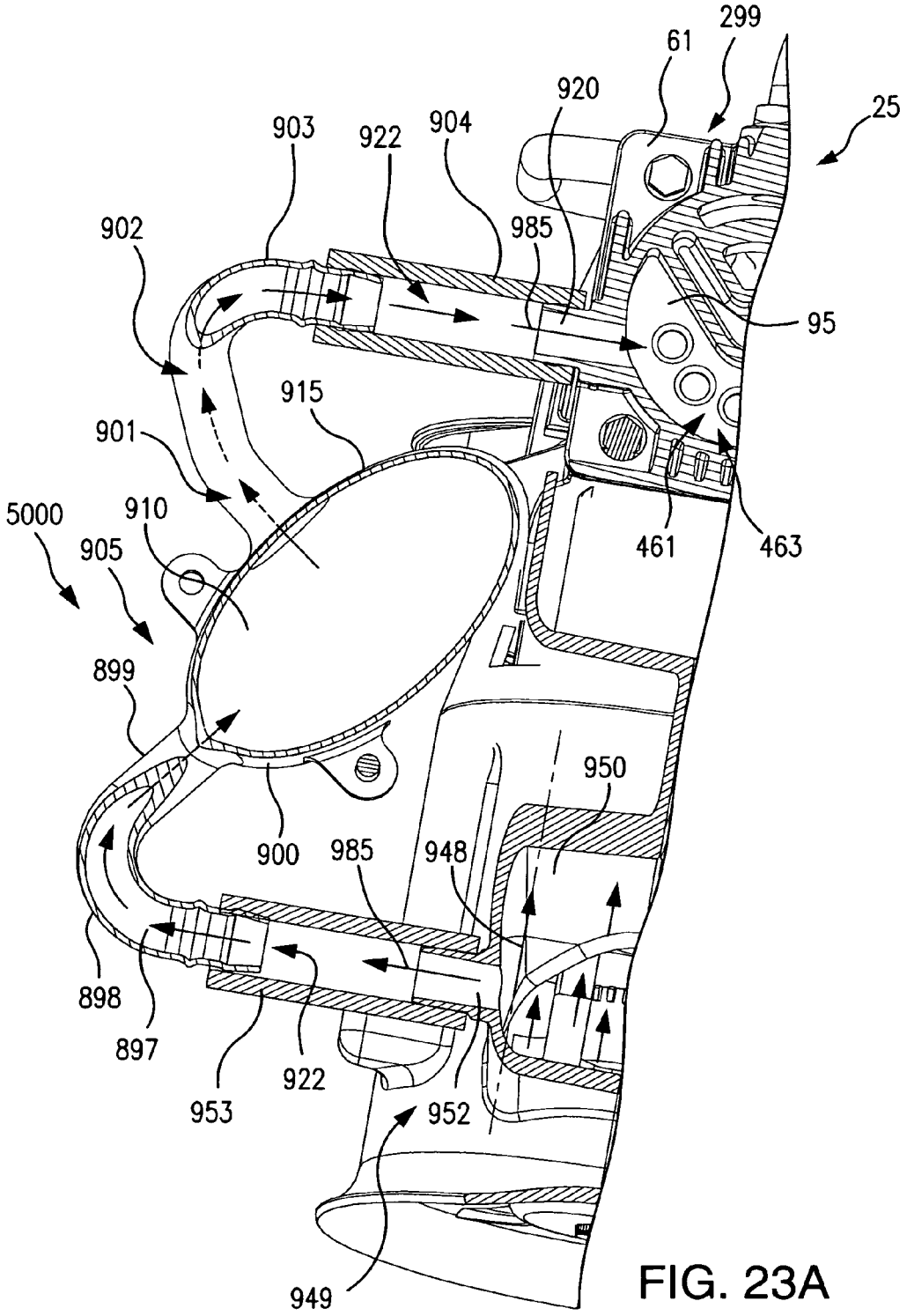
FIG. 23A is a sectional view of a high velocity muffler system.

FIG. 23A is a sectional view of a high velocity muffler system 5000 which can contribute to achieving very low compressor assembly noise values, such as 60 dBA to 70 dBA, or 65 dBA to 70 dBA, or 65 dBA to 75 dBA, or 60 dBA to 75 dBA, when the compressor assembly 20 is compressing the gas. The compressor assembly 20 noise values of 60 dBA to 75 dBA can be achieved by the designs disclosed herein at high capacities of use, for example: cooling fan flowrates of 50 SCFM to 100 SCFM; and/or heat transfer rates of 60 BTU/min to 200 BTU/min; and/or compressing 2.0 SCFM to 3.5 SCFM to outlet pressures equal to or greater than 25 PSIG, such as 50 PSIG, or 75 PSIG, or 135 PSIG, or 150 PSIG, or 175 PSIG, or 200 PSIG, or higher.

Figure 24A:
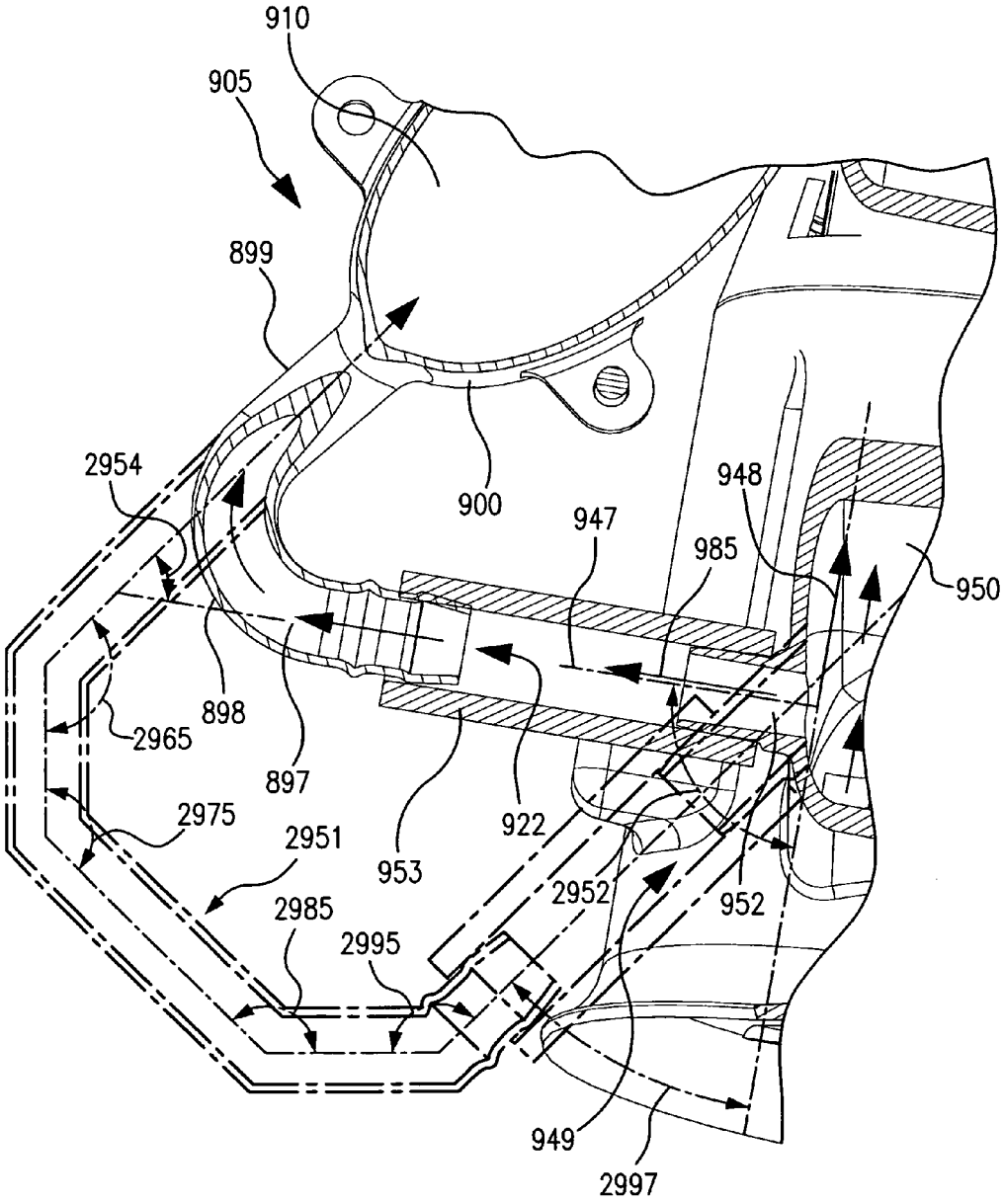
FIG. 24A is a sectional view of example inertia filter feed configurations.
Figure 24B:
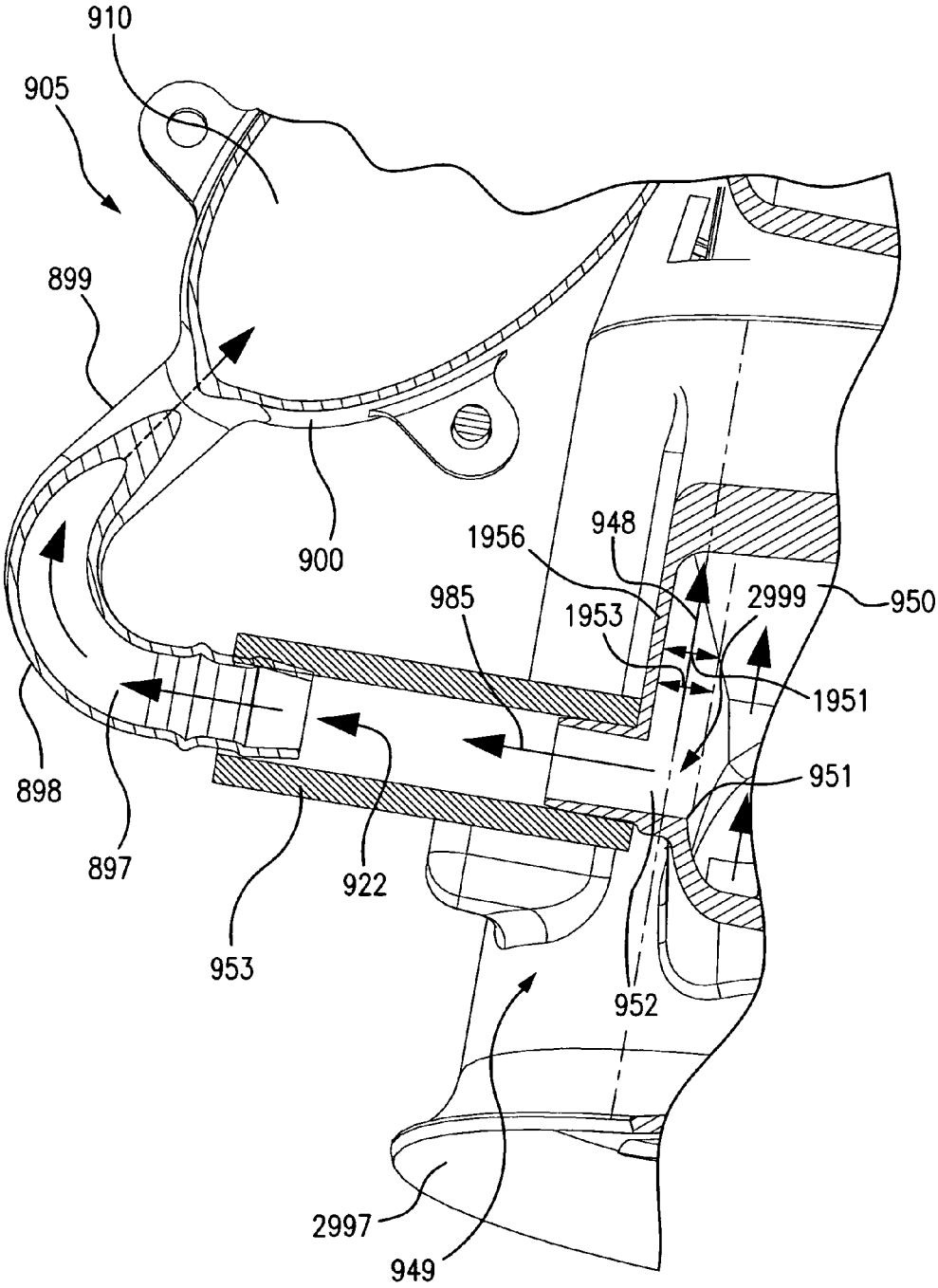
FIG. 24B is a sectional view of an embodiment of a stepped inertia filter.
Figure 24C:
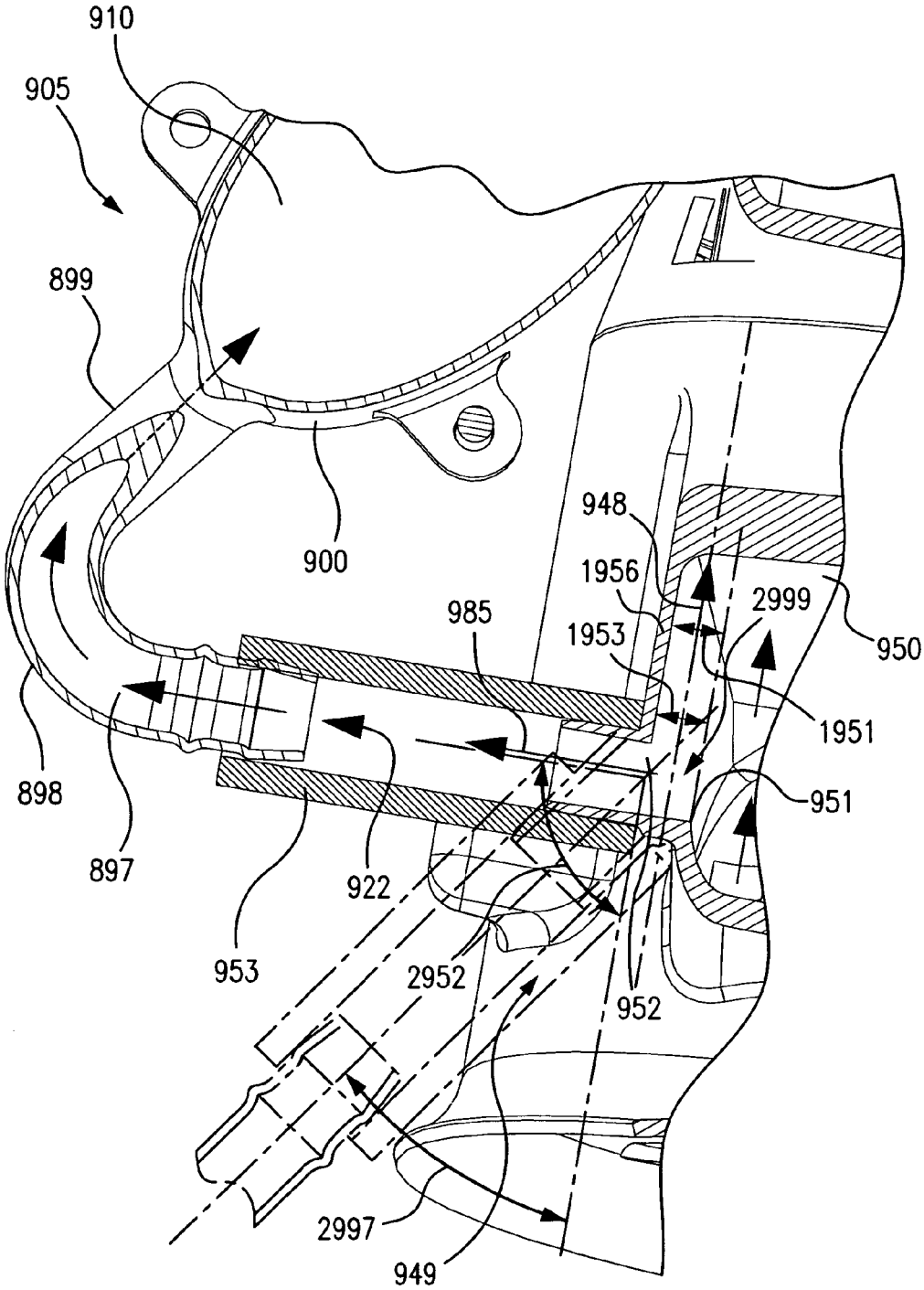
FIG. 24C is a sectional view of example feed configurations of the stepped inertia filter.
Figure 24D:
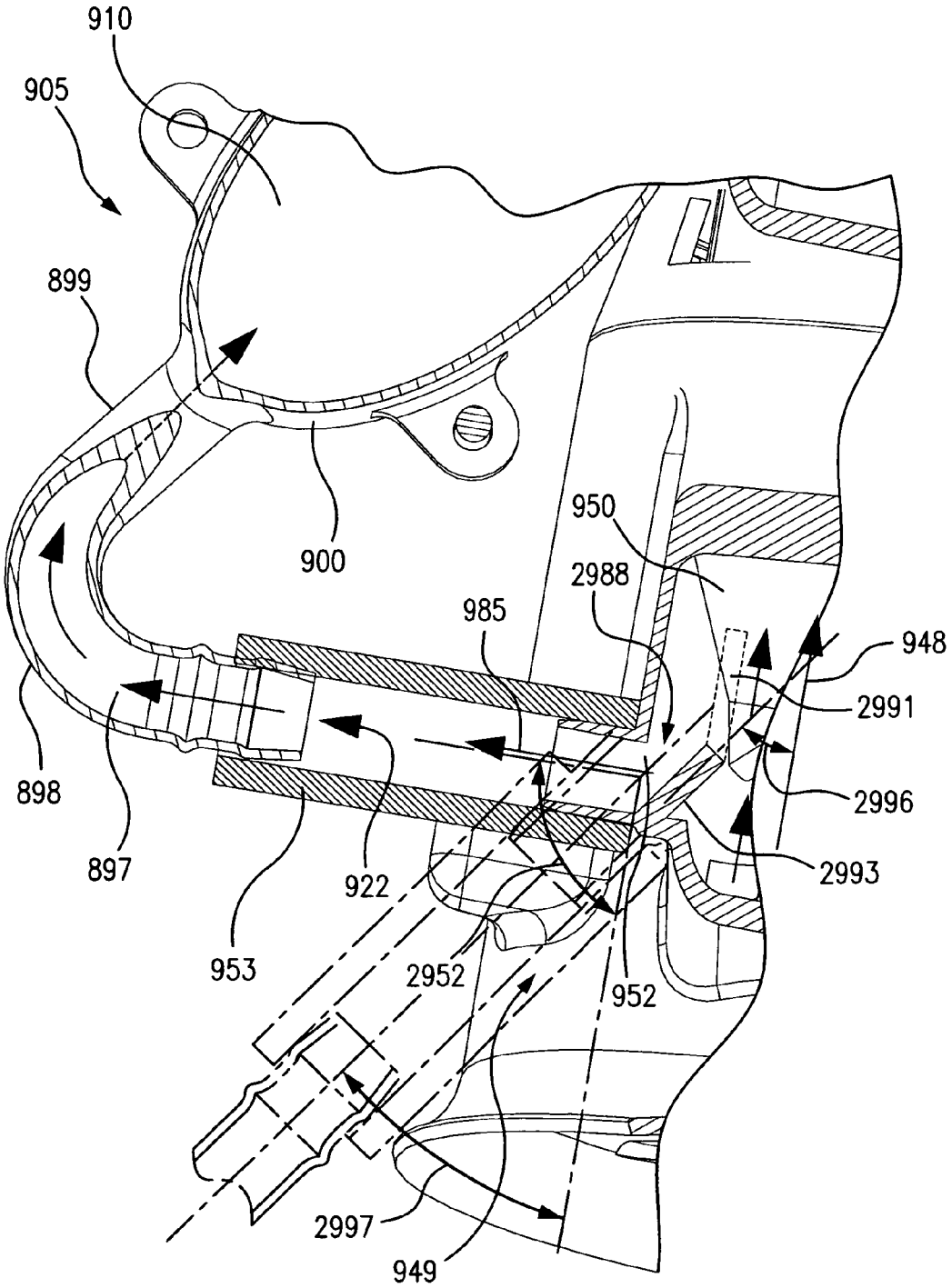
FIG. 24D is a sectional view of embodiments of a recessed inertia filter.

As shown in FIG. 23A, the high velocity muffler system 5000 can have an inertia filter 949 which can have any of a variety of designs, such as a T-inertia filter (FIG. 23A), or a stepped inertia filter 2999 (FIG. 24B and FIG. 24C), or a recessed inertia filter 2988 (FIG. 24D). The inertia filter 949 can operate under positive or negative pressure and can draw feed air in through the feed air port 952. Particles bypass the inertia filter inlet because the particles' inertia and direction of movement, such as in-line with the direction of air feed flow 948. The movement of particles past the feed air port 952 of inertia filter 949 can be such that the particles are not drawn into the feed air port 82 and which as a result can produce a particle-free flow of air into the air port 952. The particles passing and not entering the feed air port 952 can result in a particle-free flow of a compressor pump feed 985 which can feed the cylinder head 61. The compressor pump feed 985 can be fed to the cylinder head 61 of the pump assembly 25. The particle-free flow of the compressor pump feed 985 eliminates the need for filter media in the compressor pump feed system, such as in the high velocity muffler system 5000, and keeps the compressor feed path and high velocity muffler system 5000 clean of accumulated particulates and maintenance-free.

The inertia filter can filter a broad variety of materials from the cooling air which is drawn into the feed air port 952 to become the compressor pump feed 985. FIG. 29 is a table of filtered particle size distribution data for particles which can be filtered by the inertia filter 949 to produce the compressor pump feed 985. The type of particles which can be inertia filtered is without limitation. In an embodiment, particles having sizes greater than 0.001μ can be filtered by inertia filtering. FIG. 29 provides non-limiting examples of particles and particle sizes which can be present in cooling air and removed from the compressor pump feed 985 by inertia filtering by the inertia filter 949. Such particles include but are not limited to drywall dust; sand; saw dust; cement dust; airborne liquid droplets; dry clay; atmospheric dust; diatomaceous earth; airborne paint; graphite brush dust; joint compound; and airborne liquid water droplets. In the examples herein, "drywall dust" means dust having a dimension equal to 1μ or greater which can result from the sanding of applied and dried drywall joint compound. In the examples herein, "joint compound" means dry powdered drywall joint compound having a dimension of equal to 1μ or greater.

As shown in FIG. 29, particles which can be filtered by the inertia filter 949 can range from 0.00075μ, such as for tiny particle size atmospheric dust, to 10000μ or larger, such as for sand particles. The inertia filter 949 can remove any type of particles which can shorten the life of the compressor assembly 20 and/or cylinder head 61. The inertia filter 949 can remove particles equal to or greater than 0.05μ which have sufficient inertia to pass across the feed air port 952 without being drawn onto the compressor pump feed 985. The following are non-limiting examples of a selection of particles selected from a broad variety of particle types which can be filtered by the inertia filter 949. For example, the inertia filter 949 can remove particles of drywall dust having a particle size equal to or greater than 0.75μ, such as 1μ, or 1.5μ, or 2μ, or 3μ, or 5μ, or greater. The inertia filter 949 can remove particles of sand having a particle size equal to or greater than 60μ, such as 100μ, or 5050μ, or 10000μ, or greater. The inertia filter 949 can remove particles of saw dust having a particle size equal to or greater than 20μ, such as 30μ, or 315μ, or 600μ, or greater. The inertia filter 949 can remove particles of cement dust having a particle size equal to or greater than 0.5μ, such as 1μ, or 3μ, or 52μ, or 100μ, or greater. The inertia filter 949 can remove particles of dry clay having a particle size equal to or greater than 0.05μ, such as 0.1μ, or 25μ, or 50μ, or greater. The inertia filter 949 can remove particles of graphite brush dust having a particle size equal to or greater than 1μ, such as 5μ, or 20μ or 90μ or greater. The inertia filter 949 can remove particles of airborne paint having a particle size equal to or greater than 4μ, such as 7μ, or 20μ, or 10μ, or greater. The inertia filter 949 can remove particles of airborne liquid droplets and/or airborne liquid water droplets having a particle size equal to or greater than 0.2μ, such as 0.5μ, or 3μ, or 5μ, or greater.

In another respect, FIG. 30 provides a table of average momentum for particles and particle sizes which can be inertia filtered by embodiments of the inertia filter 949. Momentum values disclosed herein assume a spherical particle shape and an air velocity at the entrance to the inertia filter of 15.98 m/sec of cooling air passing across the feed air port 952 of the inertia filter 949. For example, the inertia filter 949 can remove particles of sand having a mass of 8.33×10-07 g or greater and a momentum of 1.33×10-08 kg m/sec or greater. Saw dust having a mass of 4.10×10-09 g or greater and a momentum of 6.55×10-11 kg m/sec or greater can be removed by the inertia filter 949. Graphite brush dust having a mass of 5.04×10-11 g or greater and a momentum of 8.05×10-13 kg m/sec or greater can be removed by the inertia filter 949. Cement dust having a mass of 1.13×10-11 g or greater and a momentum of 1.81×10-13 kg m/sec or greater can be removed by the inertia filter 949. Joint compound having a mass of 3.36×10-13 g or greater and a momentum of 1.41×10-15 kg m/sec or greater can be removed by the inertia filter 949. Airborne liquid water droplets having a mass of 6.53×10-14 g or greater and a momentum of 1.04×10-15 kg m/sec or greater can be removed by the inertia filter 949. Dry clay having a mass of 4.19×10-16 g or greater and a momentum of 6.69×10-18 kg m/sec or greater can be removed by the inertia filter 949. Drywall dust having a mass of 3.36×10-16 g or greater and a momentum of 5.36×10-18 kg m/sec or greater can be removed by the inertia filter 949.

FIG. 30 provides a table of moment of inertia and particle sizes which can be inertia filtered by embodiments of the inertia filter 949. Moment of inertia values disclosed herein assume a spherical particle shape and a cooling air velocity passing across the inertia filter 949 at the feed air port 952 of 15.98 m/sec. For example, the inertia filter 949 can remove particles of sand having a mass of 8.33×10-07 g or greater and a moment of inertia of 8.33×10-19 kg*m^2 or greater. Saw dust having a mass of 4.10×10-09 g or greater and a moment of inertia of 3.69×10-22 kg*m^2 or greater can be removed by the inertia filter 949. Graphite brush dust having a mass of 5.04×10-11 g or greater and a moment of inertia of 1.26×10-25 kg*m^2 or greater can be removed by the inertia filter 949. Cement dust having a mass of 1.13×10-11 g or greater and a moment of inertia of 1.02×10-26 kg*m^2 or greater can be removed by the inertia filter 949. Joint compound having a mass of 3.36×10-13 g or greater and a moment of inertia of 3.36×10-29 kg*m^2 or greater can be removed by the inertia filter 949. Airborne liquid water droplets having a mass of 6.53×10-14 g or greater and a moment of inertia of 1.63×10-30 kg*m^2 or greater can be removed by the inertia filter 949. Dry clay having a mass of 4.19×10-16 g or greater and a moment of inertia of 4.19×10-34 kg*m^2 or greater can be removed by the inertia filter 949. Drywall dust having a mass of 3.36×10-16 g or greater and a moment of inertia of 3.36×10-34 kg*m^2 or greater can be removed by the inertia filter 949.

The momentum and moment of inertia values herein are not limiting and a wide range of particle shapes, and cooling air velocities across the entrance of the feed air port 952 of the inertia filter 949, are encompassed by this disclosure. For example, the air velocities across the entrance of the inertia filter can range from 7 m/sec to 50 m/sec, such as 10 m/sec, or 14 m/sec, or 15 m/sec, or 18 m/sec, or 20 m/sec, or 25 m/sec, or 30 m/sec.

In an embodiment, the high velocity muffler system 5000 can provide the compressor pump feed 985 at a rate of 1.5 SCFM to 4.0 SCFM. The velocity of inertia filter flow rates feeding the intake muffler 900 and/or cylinder head 61 can be in a range of 2686 ft/min to 7164 ft/min.

The high velocity muffler system 5000 having an inertia filter 949 can be a particle-free muffler system providing a particle-free feed stream to the cylinder head 61. Herein, "particle-free" means any compressor pump feed 985 which has been filtered by the inertia filter. The filtering action of the inertia filter can produce the compressor pump feed 985 which is free of particulate matter and can be considered a particle-free feed stream to the compressor pump 299 having cylinder head 61.

In an embodiment, the inertia filter and muffler do not have any filter medium. Herein, "maintenance-free muffler" means any muffler not having filter medium, or which has a filter medium which receives, as feed, a gas which has been filtered by the inertia filter 949. In an embodiment, the feed pathway from the inertia filter chamber 950 through the cylinder head 61 is free of any filter medium. The use of the inertia filter and the elimination of a need to use filter media eliminates any need for maintenance, or filter media replacement, to keep the feed pathway clear of buildup and the high velocity muffler system 5000 achieves a very low pressure drop.

In an embodiment, the inertia filter can remove 95% or greater of particles present in the cooling air passing the feed air port 952 at a velocity of 15.98 m/sec when the particles' diameter is equal to or greater than 1μ. Herein, the percentage of particles removed is also referred to as the "efficiency" of the filter. In an embodiment, the inertia filter removed 99% or greater of the particles present in the cooling air passing the feed air port 952 at a velocity of 15.98 m/sec when the particles' diameter is equal to or greater than 1μ. In other embodiments, the inertia filter removed 99% or greater of the particles having particle sizes greater than 3μ present in the cooling air passing the feed air port 952 at a velocity of 15.98 m/sec when the particles' diameter is equal to or greater than 3μ. In another embodiment, under drywall dust particle conditions, the inertia filter removed particles in a range of from 95% to greater than 99% efficiency for particles having particle diameters equal to and greater than 1μ. In another embodiment, the inertia filter can remove from 95% to greater than 99% of drywall dust particles having a mass equal to or greater than 8.84×10-14 g and a momentum of 1.41×10-15 kg msec or greater.

The efficiency of the inertia filter 949 of the high velocity muffler system 5000 and the low contamination of particles in the compressor pump feed 985 can dramatically lengthen the lifespan of the compressor assembly 20. An inertia filter 949 can have a high efficiency even under harsh conditions of use, such as the intake of cooling air feed having very high particle counts. For non-limiting example, a cooling air feed having a high particle count can exist when a thick cloud of drywall dust is present in the source of the cooling air feed. In an embodiment, drywall dust having a concentration in a range of 100-5000 mg/m^3 can be removed with an efficiency in a range of from 90% to 99% or greater, or 95% to 99% or greater. The high velocity muffler system 5000 having an inertia filter 949 can be used in various embodiments to achieve an operating life of the compressor assembly 20 of 25 years or greater.

By another measure, the high velocity muffler system 5000 having an inertia filter 949 can be used to achieve an operating life of the compressor assembly 20 of, for example 500 hrs or greater of maintenance-free use. In an embodiment, the high velocity muffler system 5000 having an inertia filter 949 can be used to achieve an operating life of the pump assembly 25 and/or the pump cylinder 60 and/or cylinder head 61 of the pump assembly 25 of, for example 500 hrs or greater of maintenance-free use.

In an embodiment, the high velocity muffler system 5000 having an inertia filter 949 can be a low pressure drop muffler system. In an embodiment, the pressure drop across the inertia filter 949 can be 0.08 psi to 0.37 psi and the pressure drop across the intake muffler 900 can be 0.13 psi to 0.56 psi. The pressure drop across the high velocity muffler system 5000 from the feed air port 952 of the inertia filter to the exit of the or the muffler chamber 910 and/or cylinder head 61 intake can be less than 1 psi, such as in a range of 0.21 psi to 0.93 psi.

FIG. 24 is an embodiment of a rear view of the geometry of an example feed air path 922. In an embodiment, muffler feed angle 2899 can have an angle in a range of from 66 degrees to 145 degrees. In an embodiment, muffler feed angle 2899 can be 90 degrees and muffler outlet angle 2901 can be 90 degrees.

The muffler outlet portion 901 can have a muffler outlet centerline 1901. The hose feed portion 903 can connect to the cylinder head feed hose 904 which can provide compressed air feed to cylinder head intake port 920.

In an embodiment, the muffler feed centerline 1899 and the muffler outlet centerline 1901 cross at an angle in a range of from 66 degrees to 156 degrees. In an embodiment, the muffler feed centerline 1899 and the muffler outlet centerline 1901 are perpendicular to each other.

In an embodiment, muffler inlet angle 2954 can have a value of from 33 degrees to 156 degrees. In an embodiment, muffler inlet angle 2954 can be 51.9 degrees. In an embodiment, head feed angle 2061 can be 38.1 degrees. In an embodiment, feed tilt angle 2955 can be 38.1 degrees. In an embodiment, muffled feed tilt angle 2956 can be 51.9 degrees.

In an embodiment, the inner diameter (also herein as "ID") of an air intake hose 953, can be 0.500 in. In an embodiment, the ID of the intake muffler feed line 898 can be 0.400 in. In an embodiment, the ID of muffler feed orifice 954 can be 0.370 in. In an embodiment, the ID of the muffler exit orifice 957 can be 0.370 in. In an embodiment, the ID of the muffler outlet line 902 can be 0.400 in. In an embodiment, the ID of the cylinder head feed hose 904 can be 0.500 in.

FIG. 24A is a sectional view of example inertia filter feed configurations. In an embodiment, the inertia filter 949 can be configured such that the inertia filter axis 947 can have an inertia filter feed angle 2952 which can be perpendicular to the direction of air feed flow 948. In other embodiments, the inertia filter feed angle 2952 can be greater than 90° or less than 90°. In an embodiment, the inertia filter feed angle 2952 can have a value in a range of from 90° to 115°, or from 90° to 135°.

FIG. 24A shows by phantom lines an inertia filter 949 which has a counterflow feed angle 2997 of 45°. Herein, the inertia filter feed angle 2952 which is less than 90° is considered to constitute, and is synonymous with, a counterflow feed angle 2997. The counterflow feed angle 2997 can have any value greater than zero and less than 90°, such as 33°, or 45°, or 66°, or 75°, or 80°, or 89°.

FIG. 24A shows by phantom lines a low pressure drop feed line 2951 configured to reduce pressure drop between the inertia filter chamber 950 and the intake muffler 900. In an embodiment, the low pressure drop feed line 2951 can comprise at least one angle which is not 90°. FIG. 24A illustrates an embodiment in which each of a line angle 2995, 2985, 2975 and 2965 are 135°. In the embodiment of FIG. 24A no angle of the low pressure drop feed line 2951 is 90°. One or more of the line angles can be less than or greater than 90°. In an embodiment, the low pressure drop feed line 2951 can be in part or wholly, curved, U-shaped, semi-circular, sinusoidal, spiral or bent.

FIG. 24B is a sectional view of a stepped inertia filter 2999. A stepped inertia filter 2999 can have one or more steps between a source location of feed air and the feed air port 952. In an embodiment, the stepped inertia filter can have one or more steps, such as 1 . . . n steps, in which for example n=1 to 100, located upstream of the feed air port 952. FIG. 24B shows a stepped inertia filter 2999 having one of a filter feed step 1953. There is no limit to the number n of filter feed steps which can be used. In an embodiment, one or more filter feed ramps can be used instead of a feed step or a number of feed steps. A combination of one or more filter feed steps and one or more filter feed ramps can also be used. The embodiment of FIG. 24B uses the filter feed step 1953 having a filter ledge 951 and a step shelf 1956 which are separated by a step distance 1951. In an embodiment, the step distance 1951 can be equal to or greater than 0.25 cm, or in a range of from 0.25 cm to 10 cm, such as 0.5 cm, or 1 cm, or 1.5 cm, or 2 cm, or 2.5 cm, or 3 cm, or greater.

There is no limitation as to the length of the step distance 1953, or of multiple filter step distances which may be used. The use of one or more of the filter feed step 1953 can increase the efficiency of the inertia filter 949, reduce the particles potentially drawn into the inertia filter 949 and improve the particle-free quality of the compressor pump feed 985 which flows from the high velocity muffler system 5000 and into the cylinder head 61.

FIG. 24C is a sectional view of example feed configurations of the stepped inertia filter. FIG. 24C shows by phantom lines the stepped inertia filter 2999 having a counterflow feed angle 2997 of 45°. The counterflow feed angle 2997 of the stepped inertia filter 2999 can have any value greater than zero and less than 90°, such as 33°, or 45°, or 66°, or 75°, or 80°, or 89°. The embodiment of FIG. 24C uses the filter feed step 1953 having a filter ledge 951 and the step shelf 1956 which are separated by the step distance 1951.

FIG. 24D is a sectional view of a recessed inertia filter 2988. FIG. 24D shows an embodiment of a recessed inertia filter 2988 having an inertia filter baffle 2993 which can be in part or wholly configured to have at least a portion which has a baffle angle 2996 which can have a value in a range of from 0° to 90° against the direction of air feed flow 948. The inertia filter baffle 1993 can be an angled member, a curved member, or other shape. FIG. 24D illustrates an embodiment of the recessed inertia filter 2988 having a smoothing baffle 2991 which is shown in phantom lines.

This disclosure is not limited regarding the location and/or configuration of the recessed inertia filter 2988, with or without, a baffle. The recessed inertia filter 2988, in its various embodiments, encompasses any inertia filter 949 which draws feed from a location which is offset from, or off flow path from, or separated from, or protected from, or partitioned from at least a portion of a source gas and/or a source air flow stream, such as the air feed flow 948, or its equivalent. In an embodiment, a conduit, chamber, feed line, pathway, or other configuration, can be used to locate the recessed inertia filter 2988 in a recessed location from the air feed flow 948.

Figure 25:
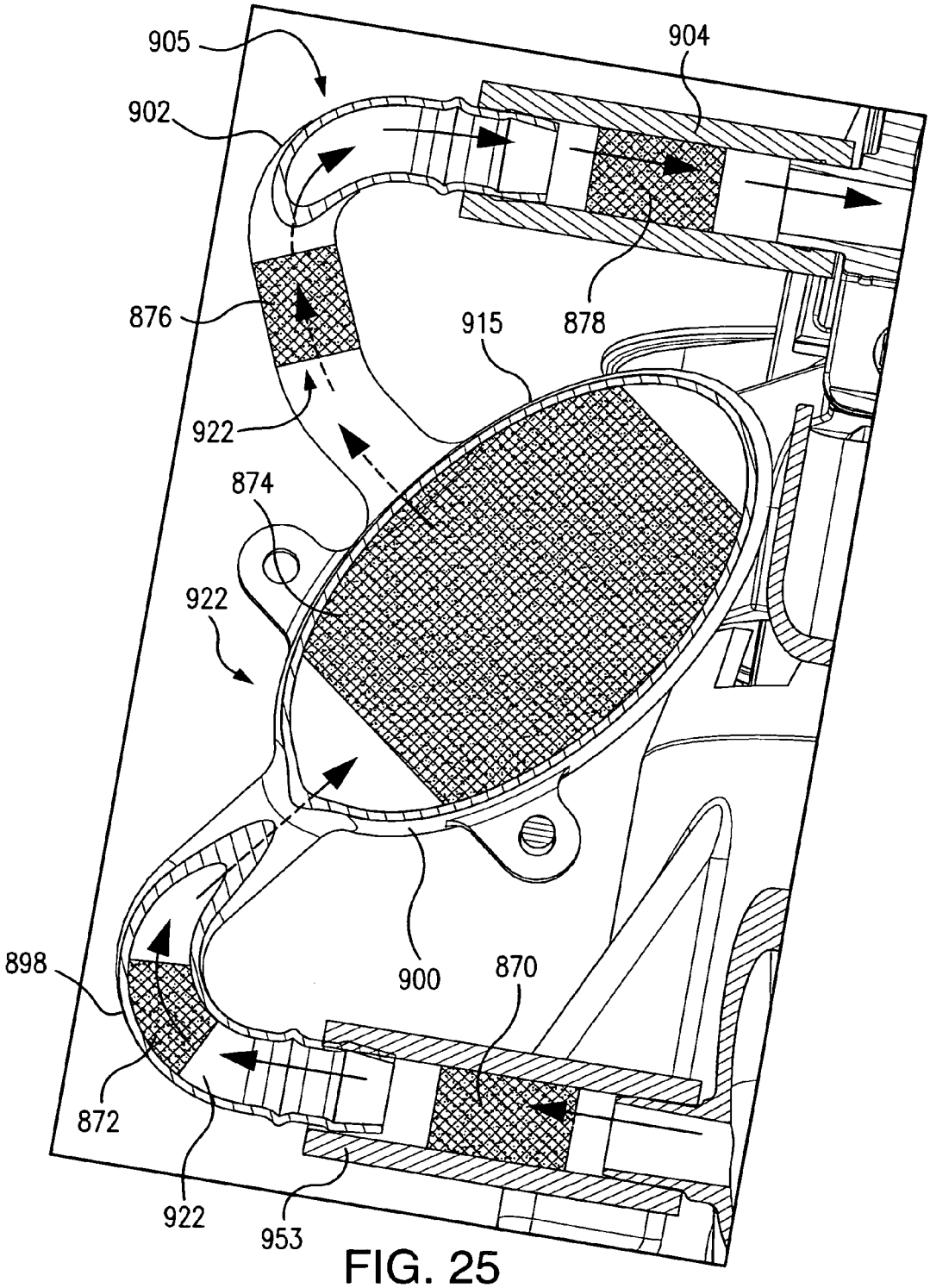
FIG. 25 illustrates the use of optional sound absorption materials in the feed air path.

FIG. 25 illustrates the use of optional sound absorption materials in the feed air path 922.

FIG. 25 illustrates the use of optional sound absorption materials in the feed air path 922. Optionally, one or a plurality of sound absorbers can be used at positions along the feed air path 922. Optionally, one or a plurality of an intake hose absorber 870 can be used in an air intake hose 953. Optionally, one or a plurality of an intake muffler feed line absorber 872 can be used in an intake muffler feed line 898. Optionally, one or a plurality of an intake muffler internal absorber 874 can be used in an intake muffler 900. Optionally, one or a plurality of a muffler outlet line absorber 876 can be used in a muffler outlet line 902. Optionally, one or a plurality of a cylinder head feed hose absorber 878 can be used in a cylinder head feed hose 904.

Figure 26:
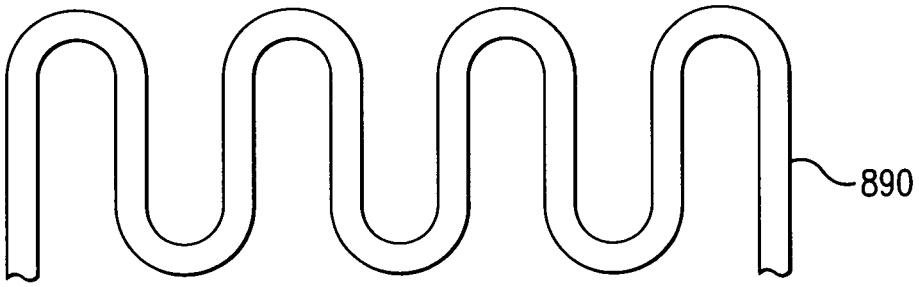
FIG. 26 is a muffler system which is sinusoidal.

FIG. 26 is a muffler system which is sinusoidal. In an embodiment, a feed air path 922 can have a sinusoidal conduit 890. The sinusoidal conduit 890 can optionally be corrugated or have a sound absorbing internal structure.

Figure 27:
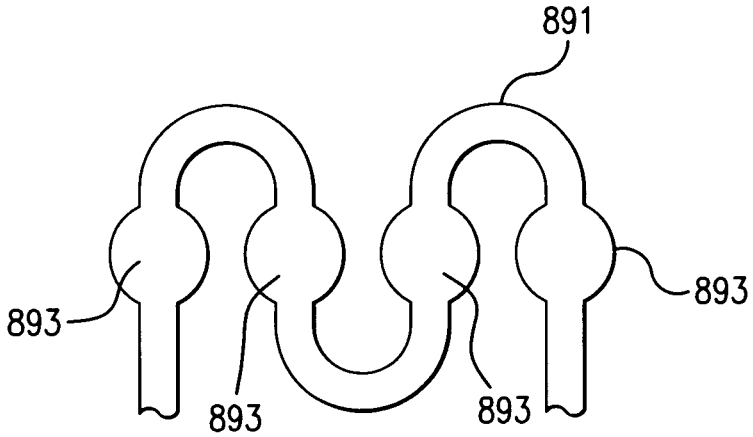
FIG. 27 is a feed air path which is sinusoidal and has a plurality of cavity mufflers.

FIG. 27 is a feed air path which is sinusoidal and has a plurality of cavity mufflers 890.

FIG. 27 is a feed air path 922 which has a sinusoidal portion 891 which has a plurality of cavity mufflers 893.

Figure 28:
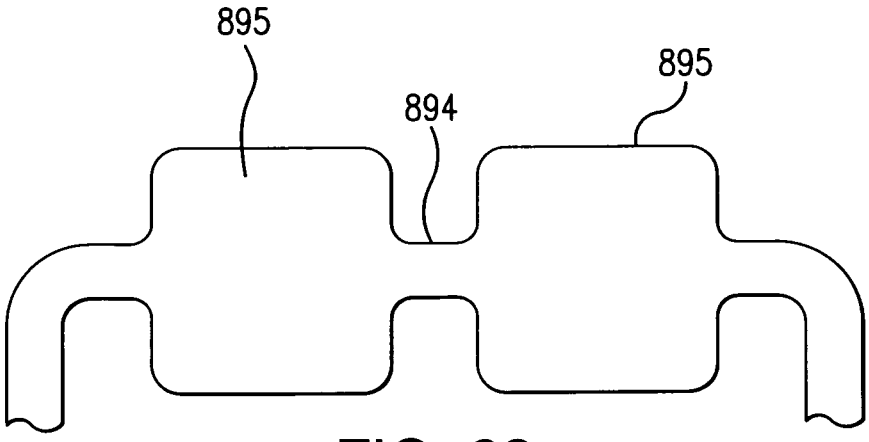
FIG. 28 is a feed air path which has a plurality of cavity mufflers.

FIG. 28 is a feed air path which has a conduit 894 which has a plurality of cavity mufflers 895.

The scope of this disclosure is to be broadly construed. It is intended that this disclosure disclose equivalents, means, systems and methods to achieve the devices, designs, operations, control systems, controls, activities, mechanical actions, fluid dynamics and results disclosed herein. For each mechanical element or mechanism disclosed, it is intended that this disclosure also encompasses within the scope of its disclosure and teaches equivalents, means, systems and methods for practicing the many aspects, mechanisms and devices disclosed herein. Additionally, this disclosure regards a compressor and its many aspects, features and elements. Such an apparatus can be dynamic in its use and operation. This disclosure is intended to encompass the equivalents, means, systems and methods of the use of the compressor assembly and its many aspects consistent with the description and spirit of the apparatus, means, methods, functions and operations disclosed herein. The claims of this application are likewise to be broadly construed.

The description of the inventions herein in their many embodiments is merely exemplary in nature and, thus, variations that do not depart from the gist of the invention are intended to be within the scope of the invention and the disclosure herein. Such variations are not to be regarded as a departure from the spirit and scope of the invention.

It will be appreciated that various modifications and changes can be made to the above described embodiments of a compressor assembly as disclosed herein without departing from the spirit and the scope of the following claims.

We claim:

1. A muffler system for a compressor assembly, comprising:

an inertia filter; and a muffler chamber;

wherein the inertia filter filters a gas which is fed to the muffler chamber and which exits the muffler chamber for compression by a pump assembly.

2. The muffler system according to claim 1, wherein the gas is air.

3. The muffler system according to claim 1, wherein the inertia filter is a T-inertia filter.

4. The muffler system according to claim 1, wherein the inertia filter is a stepped inertia filter.

5. The muffler system according to claim 1, wherein the inertia filter is a recessed inertia filter.

6. The muffler system according to claim 1, wherein the muffler chamber is free of a filter medium.

7. The muffler system according to claim 1, wherein the inertia filter has an inertia filter feed angle in a range of 15° to 90°.

8. The muffler system according to claim 1, wherein the inertia filter has a counterflow feed.

9. The muffler system according to claim 1, wherein the compressor assembly comprises an inertia filter baffle.

10. The muffler system according to claim 1, further comprising at least one of a muffler feed line and a muffler outlet line which has an inner diameter which is in a range of 5% to 75% of a diameter of the muffler chamber.

11. A method for producing a compressor pump feed, comprising the steps of:

providing a compressor pump assembly having an inertia filter, a muffler and a compressor pump;

filtering a gas by inertia filtering to produce a muffler feed;

feeding the muffler feed to the muffler; and feeding a muffler effluent to the compressor pump as a compressor pump feed.

12. A method for producing a compressor pump feed according to claim 11, further comprising the step of feeding the muffler feed to the muffler at a rate of 1.5 SCFM or greater.

13. A method for producing a compressor pump feed according to claim 11, wherein the filtering step further comprises the step of filtering a plurality of particles having a dimension equal to or greater than 1 μ.

14. A method for producing a compressor pump feed according to claim 11, wherein the filtering step further comprises the step of filtering a plurality of particles having a momentum of equal to or greater than 6.69×10−18 kg*m/sec.

15. A method for producing a compressor pump feed according to claim 11, wherein the filtering step further comprises the step of filtering a plurality of particles having an inertia of equal to or greater than 4.19×10−34 kg*m^2.

16. A method for producing a compressor pump feed according to claim 11, wherein the filtering step further comprises the step of filtering the gas through a T-inertia filter.

17. A method for producing a compressor pump feed according to claim 11, wherein the filtering step further comprises the step of filtering the gas through a stepped inertia filter.

18. A method for producing a compressor pump feed according to claim 11, wherein the filtering step further comprises the step of filtering the gas through a recessed inertia filter.

19. A method for producing a compressed gas, comprising the steps of:

providing a compressor assembly having an inertia filter, a muffler and a compressor pump;

filtering a gas feed stream through the inertia filter to produce a muffler feed;

feeding the muffler feed to the muffler to produce a compressor pump feed; and compressing the compressor pump feed to a pressure greater than 25 PSIG by the compressor pump.

20. A method for producing a compressed gas according to claim 19, wherein the compressing step further comprises compressing the compressor pump feed at a rate of 1.5 SCFM or greater and further comprising the step of producing a noise from the compressor assembly which is in a range of 60 dBA to 75 dBA when compressing the compressor pump feed.

* * * * *